US008616395B2

(12) United States Patent
Patcheak et al.

(10) Patent No.: US 8,616,395 B2
(45) Date of Patent: Dec. 31, 2013

(54) HOT-FILL CONTAINER HAVING VACUUM ACCOMMODATING BASE AND CYLINDRICAL PORTIONS

(75) Inventors: Terry D. Patcheak, Ypsilanti, MI (US); David Downing, Manchester, MI (US); Frederick C. Beuerle, Jackson, MI (US); Walter J. Strasser, Cement City, MI (US); Christopher Howe, Belleville, MI (US); Luke A. Mast, Booklyn, MI (US)

(73) Assignee: Amcor Limited, Hawthorn (AU)

( * ) Notice: Subject to any disclaimer, the term of this patent is extended or adjusted under 35 U.S.C. 154(b) by 194 days.

(21) Appl. No.: 12/847,050

(22) Filed: Jul. 30, 2010

(65) Prior Publication Data

US 2011/0017700 A1 Jan. 27, 2011

Related U.S. Application Data

(63) Continuation-in-part of application No. 12/272,400, filed on Nov. 17, 2008, now Pat. No. 8,276,774, which is a continuation-in-part of application No. 11/151,676, filed on Jun. 14, 2005, now Pat. No. 7,451,886, which is a continuation-in-part of application No. 11/116,764, filed on Apr. 28, 2005, now Pat. No. 7,150,372, which is a continuation of application No. 10/445,104, filed on May 23, 2003, now Pat. No. 6,942,116.

(60) Provisional application No. 61/230,144, filed on Jul. 31, 2009, provisional application No. 61/369,156, filed on Jul. 30, 2010.

(51) Int. Cl.
*B65D 1/02* (2006.01)
*B65D 1/46* (2006.01)

(52) U.S. Cl.
USPC ..... 215/381; 215/373; 220/609; 220/672; 220/675

(58) Field of Classification Search
USPC ..... 215/273, 381, 900; 220/666, 675, 672, 220/606, 608, 609
See application file for complete search history.

(56) References Cited

U.S. PATENT DOCUMENTS 3,409,167 A 11/1968 Blanchard
3,942,673 A 3/1976 Lyu et al.

(Continued)

FOREIGN PATENT DOCUMENTS

EP 0068718 1/1983
EP 0322651 12/1988

(Continued)

OTHER PUBLICATIONS

Supplementary European Search Report mailed Feb. 27, 2012 from corresponding European Patent Application No. EP 09826545 (six pages).

(Continued)

*Primary Examiner* — Sue A Weaver
(74) *Attorney, Agent, or Firm* — Harness, Dickey & Pierce, P.L.C.

(57) ABSTRACT

A container body and base being lightweight structures designed to accommodate vacuum forces either simultaneously or in sequence. The container body and base each absorb a significant percentage of the vacuum. By utilizing a lightweight base design to absorb a portion of the vacuum forces enables an overall light-weighting, design flexibility, and effective utilization of alternative vacuum absorbing capabilities on the container body.

10 Claims, 21 Drawing Sheets

(56) References Cited

U.S. PATENT DOCUMENTS

| | | | | |
|---|---|---|---|---|
| 4,125,632 | A | 11/1978 | Vosti et al. | |
| 4,174,782 | A | 11/1979 | Obsomer | |
| 4,231,483 | A | 11/1980 | Dechenne et al. | |
| 4,342,398 | A | 8/1982 | Chang | |
| 4,381,061 | A | 4/1983 | Cerny et al. | |
| 4,408,698 | A | 10/1983 | Ballester | |
| 4,431,112 | A | 2/1984 | Yamaguchi | |
| 4,542,029 | A | 9/1985 | Caner et al. | |
| 4,620,639 | A | 11/1986 | Yoshino | |
| 4,667,454 | A | 5/1987 | McHenry et al. | |
| 4,880,129 | A | 11/1989 | McHenry et al. | |
| 5,005,716 | A | 4/1991 | Eberle | |
| 5,060,453 | A * | 10/1991 | Alberghini et al. | 53/440 |
| 5,217,737 | A | 6/1993 | Gygax et al. | |
| 5,234,126 | A | 8/1993 | Jonas et al. | |
| 5,492,245 | A | 2/1996 | Kalkanis | |
| 5,763,030 | A | 6/1998 | Matsui | |
| RE36,639 | E | 4/2000 | Okhai | |
| 6,044,996 | A | 4/2000 | Carew et al. | |
| 6,176,382 | B1 | 1/2001 | Bazlur Rashid | |
| 6,273,282 | B1 * | 8/2001 | Ogg et al. | 215/381 |
| 6,277,321 | B1 | 8/2001 | Vailliencourt et al. | |
| 6,299,007 | B1 | 10/2001 | Takeuchi | |
| 6,595,380 | B2 | 7/2003 | Silvers | |
| 6,612,451 | B2 | 9/2003 | Tobias et al. | |
| 6,857,531 | B2 | 2/2005 | Slat et al. | |
| 6,942,116 | B2 | 9/2005 | Lisch et al. | |
| 6,983,858 | B2 | 1/2006 | Slat et al. | |
| 7,077,279 | B2 * | 7/2006 | Melrose | 215/381 |
| 7,080,747 | B2 * | 7/2006 | Lane et al. | 215/381 |
| 7,150,372 | B2 | 12/2006 | Lisch et al. | |
| 7,191,910 | B2 * | 3/2007 | Deemer et al. | 215/381 |
| 7,198,164 | B2 | 4/2007 | Yourist et al. | |
| 7,198,165 | B2 | 4/2007 | Zhang | |
| 7,258,244 | B2 | 8/2007 | Ungrady | |
| 7,451,886 | B2 | 11/2008 | Lisch et al. | |
| 7,543,713 | B2 | 6/2009 | Trude et al. | |
| 7,735,300 | B2 | 6/2010 | Outreman | |
| 7,900,425 | B2 | 3/2011 | Bysick et al. | |
| 8,276,774 | B2 | 10/2012 | Patcheak et al. | |
| 2002/0153343 | A1 | 10/2002 | Tobias et al. | |
| 2008/0047964 | A1 * | 2/2008 | Denner et al. | 220/624 |
| 2008/0073316 | A1 | 3/2008 | Stowitts | |
| 2010/0006533 | A1 | 1/2010 | Nievierowski et al. | |

FOREIGN PATENT DOCUMENTS

| | | |
|---|---|---|
| EP | 1947016 | 7/2008 |
| JP | 57-17730 | 1/1982 |
| JP | 59-174425 | 1/1984 |
| JP | 62-235041 | 10/1987 |
| JP | 01-167078 | 6/1989 |
| JP | 02-85143 | 3/1990 |
| JP | 03-097014 | 10/1991 |
| JP | 03-100788 | 10/1991 |
| JP | 3423452 | 5/1996 |
| JP | 08-156904 | 6/1996 |
| JP | 10-181734 | 7/1998 |
| JP | 2000-128140 | 5/2000 |
| JP | 2000-229615 | 8/2000 |
| JP | 2002-308245 | 10/2002 |
| JP | 2007-269392 | 10/2007 |
| JP | 2008-024314 | 2/2008 |
| JP | 2009-057074 | 3/2009 |
| WO | WO 02/085755 | 10/2002 |
| WO | WO 2004/028910 | 4/2004 |
| WO | WO 2004/106175 | 12/2004 |
| WO | WO2006/118584 | 11/2006 |
| WO | WO 2007/047574 | 4/2007 |
| WO | WO 2009/135046 | 11/2009 |

OTHER PUBLICATIONS

International Search Report and Written Opinion dated Apr. 11, 2011 from corresponding International Patent Application No. PCT/US2010/043885.

Supplementary European Search Report dated Dec. 6, 2012 in corresponding European Patent Application No. 10805103.8 (six pages).

Office Action dated Jan. 8, 2013 in corresponding Japanese Patent Application No. 2011-536376 (seven pages).

Office Action dated Sep. 4, 2012 in corresponding Japanese Patent Application No. 2010-279791 with English translation (seven pages).

Office Action dated Sep. 4, 2012 in corresponding Japanese Patent Application No. 2010-268769 with English translation (eight pages).

Office Action dated Jan. 29, 2013 in corresponding Chinese Patent Application No. 200980145391.3 with English translation (fifteen pages).

Official Action dated May 14, 2013 in corresponding Colombian Patent Application No. 12-13760 (seven pages).

* cited by examiner 20
30
32
34
36
38
40
42
44
46
48
50
52
54
56
58
64
66
68
70
72
A
B
$C_1$
$C_2$ 20
30
32
34
36
38
40
44
46
48
50
60
62
74

10
18
20
30
32
34
36
38
40
42
44
46
48
50
52
54
56
58
60
62
66
68
72
74
78
100
A
B
C1
C2

HOT-FILL CONTAINER HAVING VACUUM ACCOMMODATING BASE AND CYLINDRICAL PORTIONS

CROSS-REFERENCE TO RELATED APPLICATIONS

This application is a continuation-in-part of U.S. patent application Ser. No. 12/272,400 filed on Nov. 17, 2008, now U.S. Pat. No. 8,276,774, which is a continuation-in-part of U.S. patent application Ser. No. 11/151,676 filed on Jun. 14, 2005, now U.S. Pat. No. 7,451,886, which is a continuation-in-part of U.S. patent application Ser. No. 11/116,764 filed on Apr. 28, 2005, now U.S. Pat. No. 7,150,372, which is a continuation of U.S. patent application Ser. No. 10/445,104 filed on May 23, 2003, now U.S. Pat. No. 6,942,116. This application also claims the benefit of U.S. Provisional Patent Application No. 61/230,144, filed on Jul. 31, 2009 and U.S. Provisional Patent Application No. 61/369,156 filed Jul. 30, 2010. The entire disclosure of the above applications are incorporated herein by reference.

FIELD

The present disclosure relates to plastic containers for retaining a commodity and, more particularly, a liquid commodity, whereby the plastic container has a sidewall structure and a base structure collectively operable to create significant absorption of vacuum pressures without unwanted deformation in other portions of the container or increased weight.

BACKGROUND AND SUMMARY

This section provides background information related to the present disclosure which is not necessarily prior art. This section also provides a general summary of the disclosure, and is not a comprehensive disclosure of its full scope or all of its features.

As a result of environmental and other concerns, plastic containers, more specifically polyester and even more specifically polyethylene terephthalate (PET) containers, are now being used more than ever to package numerous commodities previously packaged in glass containers. Manufacturers and fillers, as well as consumers, have recognized that PET containers are lightweight, inexpensive, recyclable and manufacturable in large quantities.

Manufacturers currently supply PET containers for various liquid commodities, such as juice and isotonic beverages. Suppliers often fill these liquid products into the containers while the liquid product is at an elevated temperature, typically between 68° C.-96° C. (155° F.-205° F.) and usually at approximately 85° C. (185° F.). When packaged in this manner, the hot temperature of the liquid commodity sterilizes the container at the time of filling. The bottling industry refers to this process as hot filling, and containers designed to withstand the process as hot-fill or heat-set containers.

The hot filling process is acceptable for commodities having a high acid content, but not generally acceptable for non-high acid content commodities. Nonetheless, manufacturers and fillers of non-high acid content commodities desire to supply their commodities in PET containers as well.

For non-high acid commodities, pasteurization and retort are the preferred sterilization process. Pasteurization and retort both present an enormous challenge for manufactures of PET containers in that heat-set containers cannot withstand the temperature and time demands required of pasteurization and retort.

Pasteurization and retort are both processes for cooking or sterilizing the contents of a container after filling. Both processes include the heating of the contents of the container to a specified temperature, usually above approximately 70° C. (approximately 155° F.), for a specified length of time (20-60 minutes). Retort differs from pasteurization in that retort uses higher temperatures to sterilize the container and cook its contents. Retort also applies elevated air pressure externally to the container to counteract pressure inside the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \frac{\rho - \rho_\alpha}{\rho_c - \rho_\alpha} \times 100$$

where $\rho$ is the density of the PET material; $\rho_\alpha$ is the density of pure amorphous PET material (1.333 g/cc); and $\rho_c$ is the density of pure crystalline material (1.455 g/cc).

Container manufactures use mechanical processing and thermal processing to increase the PET polymer crystallinity of a container. Mechanical processing involves orienting the amorphous material to achieve strain hardening. This processing commonly involves stretching a PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 120° C.-130° C. (approximately 248° F.-266° F.), and holding the blown container against the heated mold for approximately three (3) seconds. Manufacturers of PET juice bottles, which must be hot-filled at approximately 85° C. (185° F.), currently use heat setting to produce PET bottles having an overall crystallinity in the range of approximately 25-35%.

After being hot-filled, the heat-set containers are capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-300 mm Hg less than atmospheric pressure (i.e., 759 mm Hg-460 mm Hg). If not controlled or otherwise accommodated, these vacuum pressures result in deformation of the container, which leads to either an aesthetically unacceptable container or one that is unstable.

In many instances, container weight is correlated to the amount of the final vacuum present in the container after this fill, cap and cool down procedure, that is, the container is made relatively heavy to accommodate vacuum related forces. Similarly, reducing container weight, i.e., "light-weighting" the container, while providing a significant cost savings from a material standpoint, requires a reduction in the amount of the final vacuum. Typically, the amount of the final vacuum can be reduced through various processing options such as the use of nitrogen dosing technology, minimize headspace or reduce fill temperature. One drawback with the use of nitrogen dosing technology however is that the maximum line speeds achievable with the current technology is limited to roughly 200 containers per minute. Such slower line speeds are seldom acceptable. Additionally, the dosing consistency is not yet at a technological level to achieve efficient operations. Minimizing headspace requires more precession during filling, again resulting in slower line speeds. Reducing fill temperature is equally disadvantageous as it limits the type of commodity suitable for the container.

Typically, container manufacturers accommodate vacuum pressures by incorporating structures in the container sidewall. Container manufacturers commonly refer to these structures as vacuum panels. Traditionally, these paneled areas have been semi-rigid by design, unable to accommodate the high levels of vacuum pressures currently generated, particularly in lightweight containers.

Development of technology options to achieve an ideal balance of light-weighting and design flexibility are of great interest. According to the principles of the present teachings, an alternative vacuum absorbing capability is provided within both the container body and base. Traditional hot-fill containers accommodate nearly all vacuum forces within the body (or sidewall) of the container through deflection of the vacuum panels. These containers are typically provided with a rigid base structure that substantially prevents deflection thereof and thus tends to be heavier than the rest of the container.

In contrast, POWERFLEX technology, offered by the assignee of the present application, utilizes a lightweight base design to accommodate nearly all vacuum forces. However, in order to accommodate such a large amount of vacuum, the POWERFLEX base must be designed to invert, which requires a dramatic snap-through from an outwardly curved initial shape to an inwardly curved final shape. This typically requires that the sidewall of the container be sufficiently rigid to allow the base to activate under vacuum, thus requiring more weight and/or structure within the container sidewall. Neither the traditional technology nor POWERFLEX system offers the optimal balance of a thin light-weight container body and base that is capable of withstanding the necessary vacuum pressures.

Therefore, an object of the present teachings is to achieve the optimal balance of weight and vacuum performance of both the container body and base. To achieve this, in some embodiments, a hot-fill container is provided that comprises a lightweight, flexible base design that is easily moveable to accommodate vacuum, but does not require a dramatic inversion or snap-through, thus eliminating the need for a heavy sidewall. The flexible base design serves to complement vacuum absorbing capabilities within the container sidewall. Furthermore, an object of the present teachings is to define theoretical light weighting limits and explore alternative vacuum absorbing technologies that create additional structure under vacuum.

The container body and base of the present teachings can each be lightweight structures designed to accommodate vacuum forces either simultaneously or in sequence. In any event, the goal is for both the container body and base to absorb a significant percentage of the vacuum. By utilizing a lightweight base design to absorb a portion of the vacuum forces enables an overall light-weighting, design flexibility, and effective utilization of alternative vacuum absorbing capabilities on the container sidewall. It is therefore an object of the present teachings to provide such a container. It should be understood, however, that in some embodiments some principles of the present teachings, such as the base configurations, can be used separate from other principles, such as the sidewall configurations, or vice versa.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
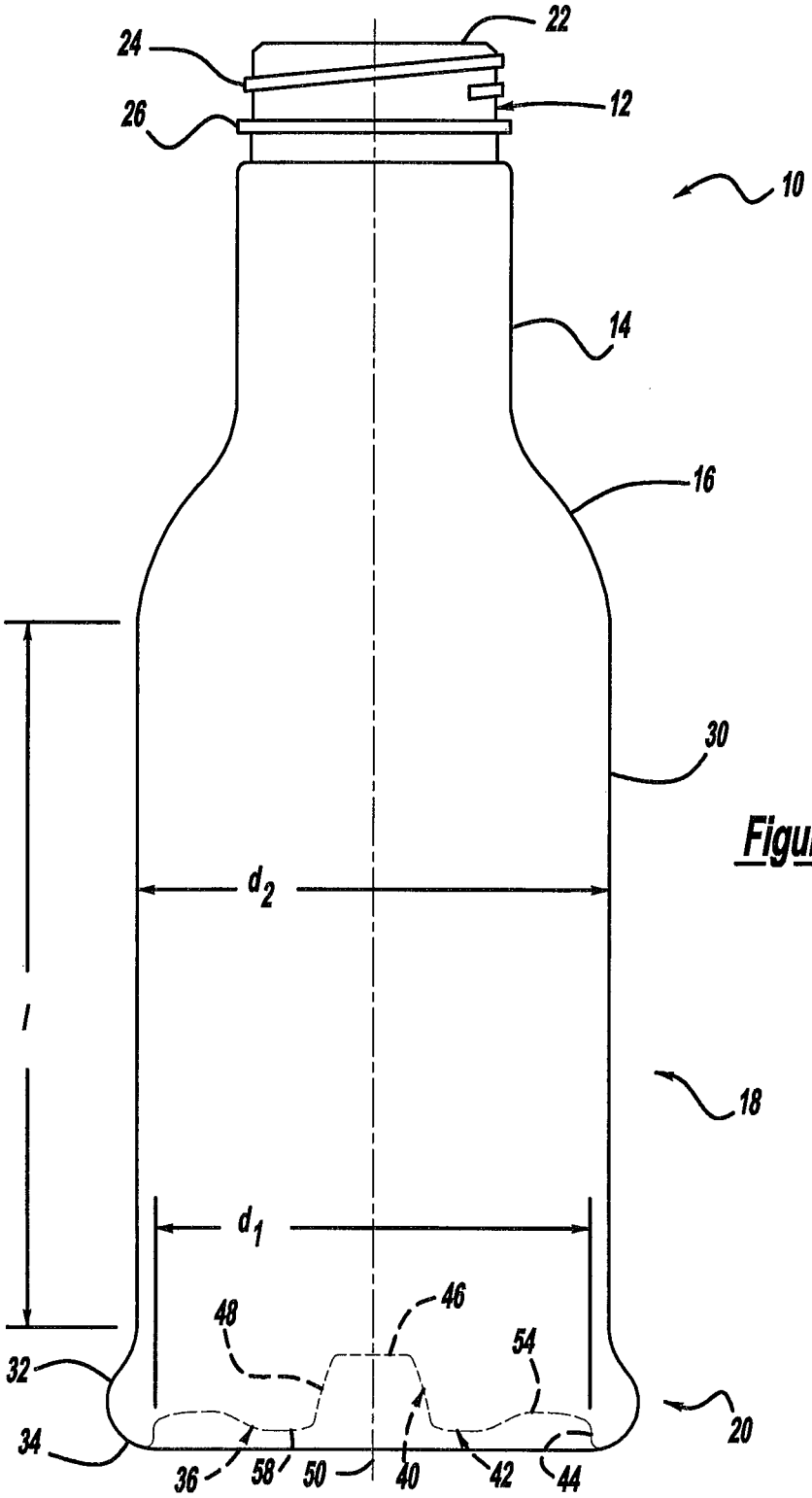
FIG. 1 is an elevational view of a plastic container according to the present teachings, the container as molded and empty.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

As discussed above, to accommodate vacuum forces during cooling of the contents within a heat-set container, containers generally have a series of vacuum panels or ribs around their sidewall. Traditionally, these vacuum panels have been semi-rigid and incapable of preventing unwanted distortion elsewhere in the container, particularly in lightweight containers. However, in some vacuum panel-less containers, a combination of controlled deformation (i.e., in the base or closure) and vacuum resistance in the remainder of the container is required. As discussed herein, each of the above examples (i.e. traditional vacuum absorbing container having a lightweight and flexible sidewall with a heavy and rigid base, and POWERFLEX container having a lightweight and flexible base with a heavy and rigid sidewall) may not fully optimize a hot-fill container design. Moreover, the simple combination of the sidewall of the traditional vacuum absorbing container and the base of the POWERFLEX container would typically lead to a container having a sidewall that is not sufficiently rigid to withstand the snap-through from an outwardly curved initial shape to an inwardly curved final shape.

Accordingly, the present teachings provide a plastic container which enables its base portion under typical hot-fill process conditions to deform and move easily while maintaining a rigid structure (i.e., against internal vacuum) in the remainder of the container. As an example, in a 16 fl. oz. plastic container, the container typically should accommodate roughly 18-24 cc of volume displacement. In the present plastic container, the base portion accommodates a majority of this requirement. The remaining portions of the plastic container are easily able to accommodate the rest of this volume displacement without readily noticeable distortion. More particularly, traditional containers utilize a combination of bottle geometry and wall thickness to create a structure that can resist a portion of the vacuum, and movable sidewall panels, collapsible ribs, or moveable bases to absorb the remaining vacuum. This results in two elements of internal vacuum—residual and absorbed. The sum of the residual vacuum and the absorbed vacuum equals the total amount of vacuum that results from the combination of the liquid commodity and the headspace contracting during cooling in a rigid container.

Although alternative designs are available in the art, including those requiring the use of external activation devices on the filling line (as in the Graham ATP technology), the present teachings are able to achieve lighter hot fillable containers, without requiring an external activation device, by absorbing a higher percentage of the internal vacuum and/or volume in a controlled way while simultaneously providing sufficient structural integrity to maintain the desired bottle shape.

In some embodiments, the container according to the present teachings combines sidewall vacuum and/or volume compensation panels or collapsible ribs with a flexible base design resulting in a hybrid of previous technologies that results in a lighter weight container than could be achieved with either method individually.

The vacuum and/or volume compensation characteristics could be defined as:

X=the percentage of the total vacuum and/or volume that is absorbed by the sidewall panels, ribs and/or other vacuum and/or volume compensation features;

Y=the percentage of the total vacuum and/or volume that is absorbed by the base movement; and Z=the residual vacuum and/or volume remaining in the container after the compensation achieved by the vacuum and/or volume compensation features in the sidewall and/or base.

In the case of the traditional vacuum compensation features (i.e. sidewall only or base only), the vacuum and/or volume compensation could be expressed as:

Z=10 to 90% of the total vacuum and/or volume; and

X OR Y=10 to 90% of the total vacuum and/or volume.

It should be appreciated from the foregoing that a conventional container could merely achieve a total of 90% of the total vacuum and/or volume.

However, according to the present teachings, a hot-fillable container is provided where the vacuum and/or volume compensation could be described as:

Z=0 to 25% of the total vacuum and/or volume;

X=10 to 90% of the total vacuum and/or volume; and

Y=10 to 90% of the total vacuum and/or volume.

As can be seen, according to these principles, the present teachings are operable to achieve vacuum absorption in both the base and the sidewall, thereby permitting, if desired, absorption of the entire internal vacuum. It should be appreciated that in some embodiments a slight remaining vacuum may be desired.

To accomplish the lightest possible container weight with respect to vacuum, the residual vacuum (Z) should be as close as possible to 0% of the total vacuum and the combined movements of the vacuum absorbing features would be designed to absorb basically 100% of the volume contraction that occurs inside of the container as the contents cool from the filling temperature to the point of maximum density under the required service conditions. At this point external forces such as top load or side load would result in a pressurization of the container that would help it to resist those external forces. This would result in a container weight that is dictated by the requirements of the handling and distribution system, not by the filling conditions.

In some embodiments, the present teachings provide a significantly round plastic container that does not ovalize below 5% total vacuum absorption that consists of a movable base and a movable sidewall at an average wall thickness less than 0.020". However, in some embodiments, the present teachings can provide a plastic container that comprises a base that absorbs between 10 and 90% of the total vacuum in conjunction with a sidewall that absorbs between 90 and 10% of the total vacuum absorbed. In some embodiments, the base and the sidewall can activate simultaneously. However, in some embodiments, the base and the sidewall can activate sequentially.

Still further, according to the present teachings, a significantly round plastic container is provided that provides a movable base and a movable sidewall that both activate simultaneously or sequentially at a vacuum level less than that of 5% of the total vacuum absorption of the container.

In a vacuum panel-less container, a combination of controlled deformation (i.e., in the base or closure) and vacuum resistance in the remainder of the container is required. Accordingly, the present teaching provides for a plastic container which enables its base portion under typical hot-fill process conditions to deform and move easily while maintaining a rigid structure (i.e., against internal vacuum) in the remainder of the container.

Figure 2:
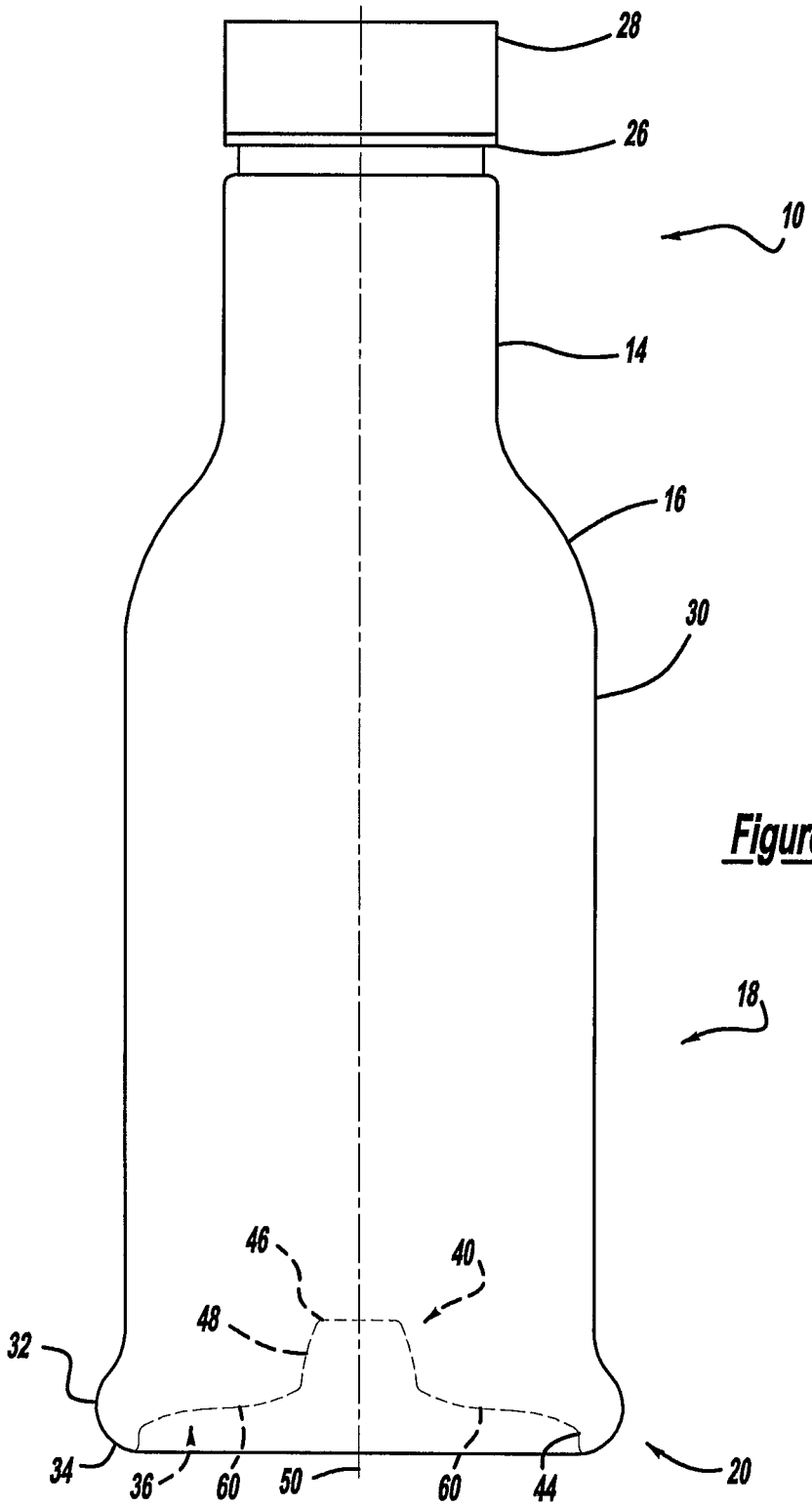
FIG. 2 is an elevational view of the plastic container according to the present teachings, the container being filled and sealed.
Figure 3:
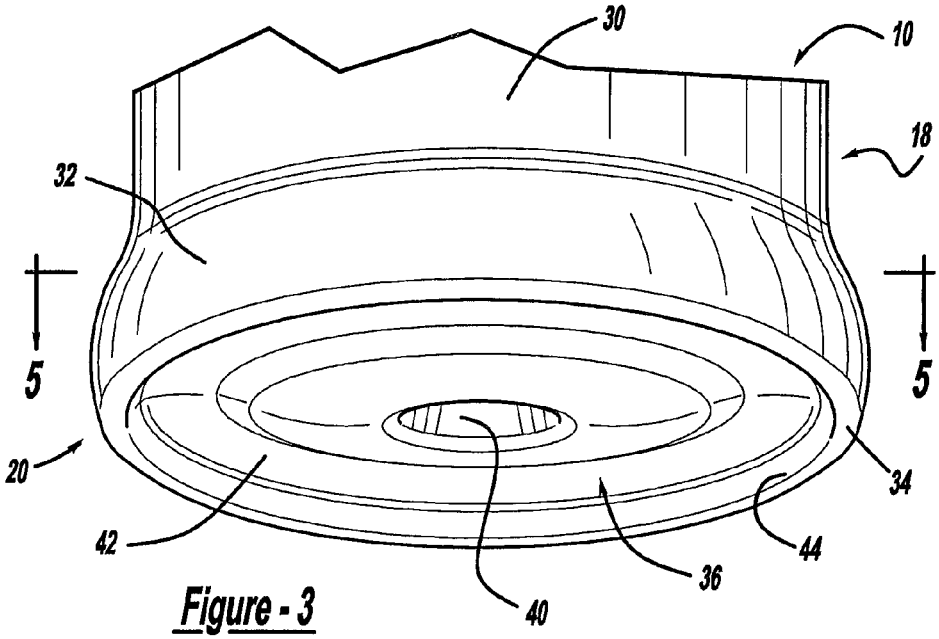
FIG. 3 is a bottom perspective view of a portion of the plastic container of FIG. 1.
Figure 4:
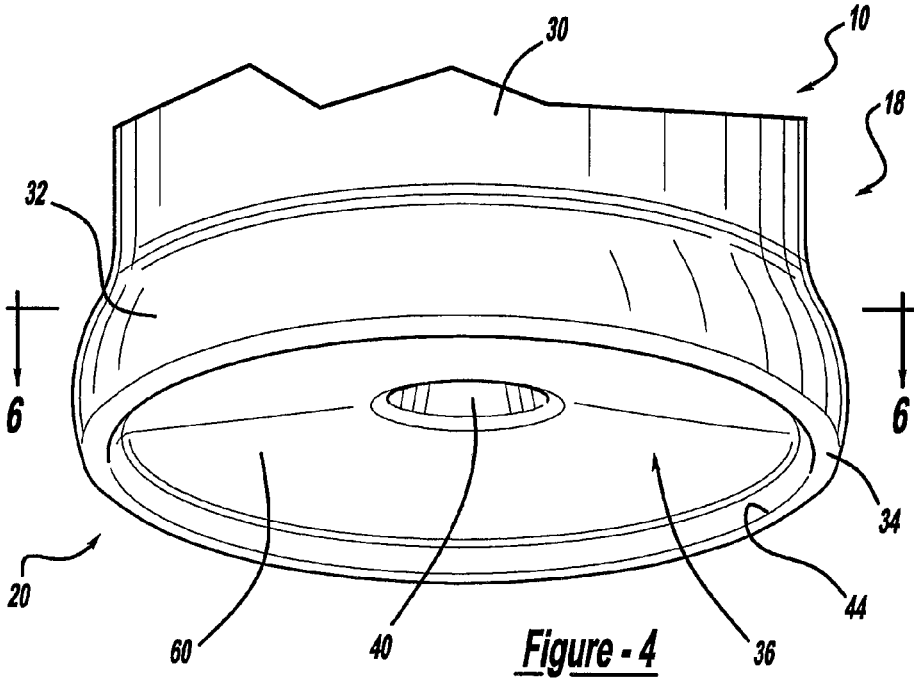
FIG. 4 is a bottom perspective view of a portion of the plastic container of FIG. 2.
Figure 5:
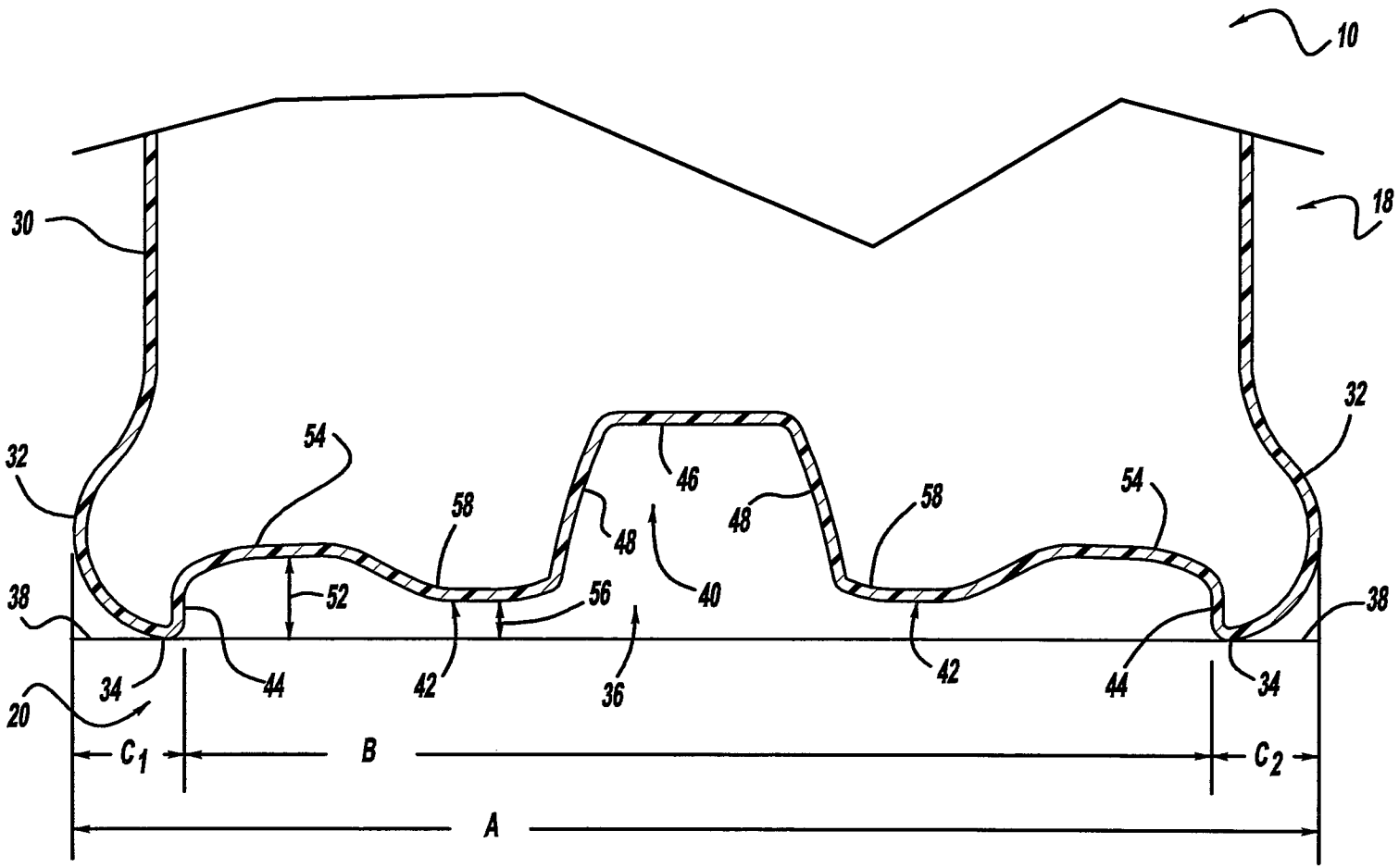
FIG. 5 is a cross-sectional view of the plastic container, taken generally along line 5-5 of FIG. 3.
Figure 6:
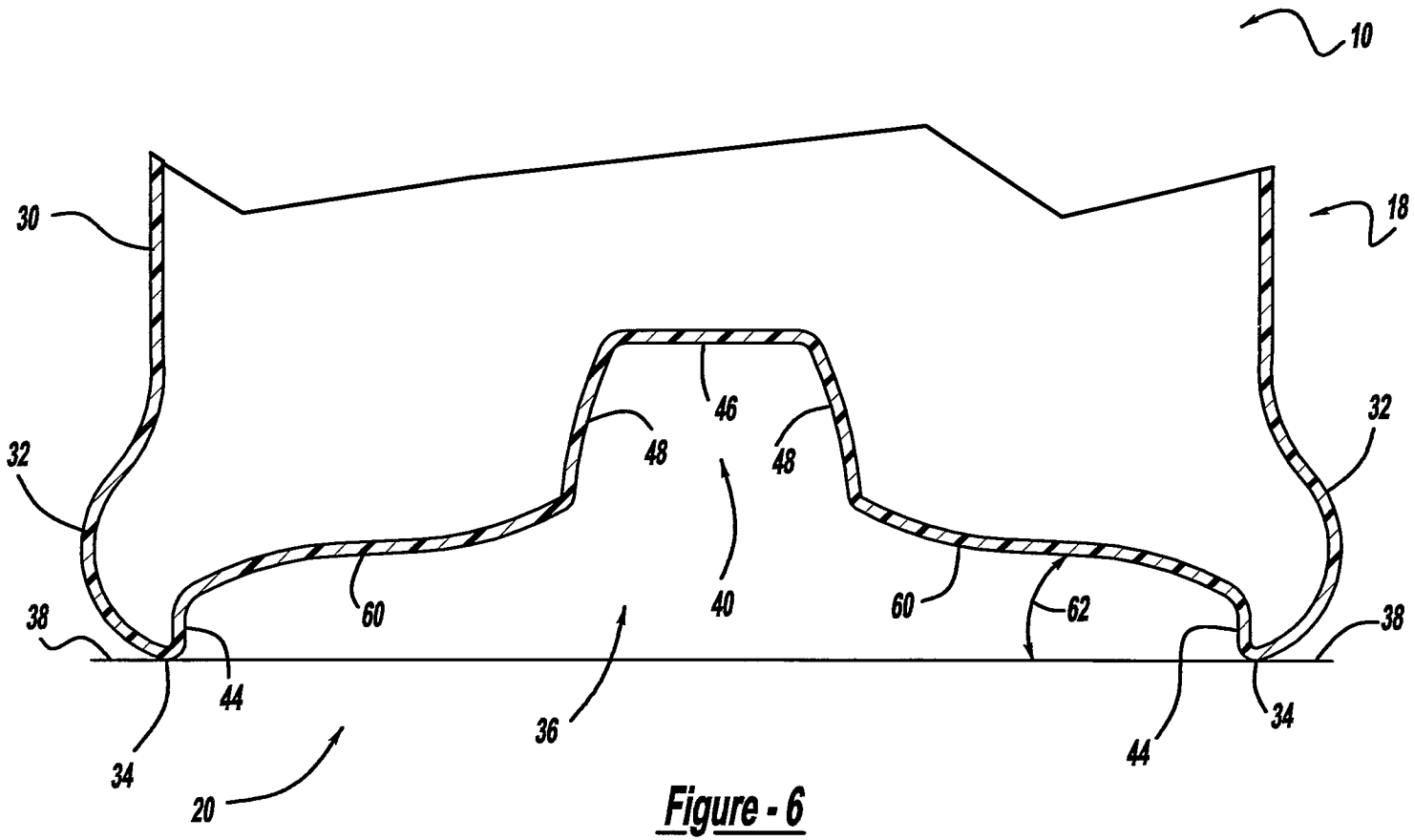
FIG. 6 is a cross-sectional view of the plastic container, taken generally along line 6-6 of FIG. 4.
Figure 7:
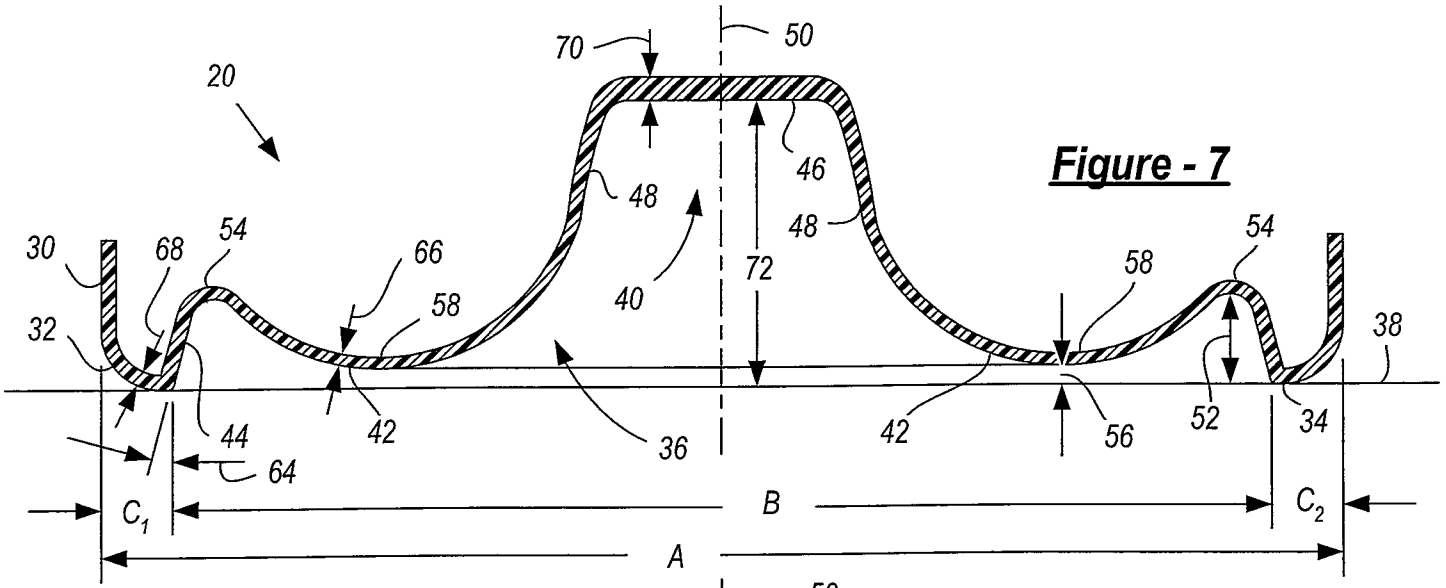
FIG. 7 is a cross-sectional view of the plastic container, similar to FIG. 5, according to some embodiments of the present teachings.

As shown in FIGS. 1 and 2, a plastic container 10 of the invention includes a finish 12, a neck or an elongated neck 14, a shoulder region 16, a body portion 18, and a base 20. Those skilled in the art know and understand that the neck 14 can have an extremely short height, that is, becoming a short extension from the finish 12, or an elongated neck as illustrated in the figures, extending between the finish 12 and the shoulder region 16. The plastic container 10 has been designed to retain a commodity during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a closure 28 before cooling. As the sealed container 10 cools, a slight vacuum, or negative pressure, forms inside causing the container 10, in particular, the base 20 to change shape. In addition, the plastic container 10 may be suitable for other high-temperature pasteurization or retort filling processes, or other thermal processes as well.

The plastic container 10 of the present teaching is a blow molded, biaxially oriented container with a unitary construction from a single or multi-layer material. A well-known stretch-molding, heat-setting process for making the hot-fillable plastic container 10 generally involves the manufacture of a preform (not illustrated) of a polyester material, such as polyethylene terephthalate (PET), having a shape well known to those skilled in the art similar to a test-tube with a generally cylindrical cross section and a length typically approximately fifty percent (50%) that of the container height. A machine (not illustrated) places the preform heated to a temperature between approximately 190° F. to 250° F. (approximately 88° C. to 121° C.) into a mold cavity (not illustrated) having a shape similar to the plastic container 10. The mold cavity is heated to a temperature between approximately 250° F. to 350° F. (approximately 121° C. to 177° C.). A stretch rod apparatus (not illustrated) stretches or extends the heated preform within the mold cavity to a length approximately that of the container thereby molecularly orienting the polyester material in an axial direction generally corresponding with a central longitudinal axis 50. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container. Typically, material within the finish 12 and a sub-portion of the base 20 are not substantially molecularly oriented. The pressurized air holds the mostly biaxial molecularly oriented polyester material against the mold cavity for a period of approximately two (2) to five (5) seconds before removal of the container from the mold cavity. To achieve appropriate material distribution within the base 20, the inventors employ an additional stretch-molding step substantially as taught by U.S. Pat. No. 6,277,321 which is incorporated herein by reference.

Alternatively, other manufacturing methods using other conventional materials including, for example, high density polyethylene, polypropylene, polyethylene naphthalate (PEN), a PET/PEN blend or copolymer, and various multi-layer structures may be suitable for the manufacture of plastic container 10. Those having ordinary skill in the art will readily know and understand plastic container 10 manufacturing method alternatives.

The finish 12 of the plastic container 10 includes a portion defining an aperture or mouth 22, a threaded region 24, and a support ring 26. The aperture 22 allows the plastic container 10 to receive a commodity while the threaded region 24 provides a means for attachment of the similarly threaded closure or cap 28 (shown in FIG. 2). Alternatives may include other suitable devices that engage the finish 12 of the plastic container 10. Accordingly, the closure or cap 28 engages the finish 12 to preferably provide a hermetical seal of the plastic container 10. The closure or cap 28 is preferably of a plastic or metal material conventional to the closure industry and suitable for subsequent thermal processing, including high temperature pasteurization and retort. The support ring 26 may be used to carry or orient the preform (the precursor to the plastic container 10) (not shown) through and at various stages of manufacture. For example, the preform may be carried by the support ring 26, the support ring 26 may be used to aid in positioning the preform in the mold, or an end consumer may use the support ring 26 to carry the plastic container 10 once manufactured.

The elongated neck 14 of the plastic container 10 in part enables the plastic container 10 to accommodate volume requirements. Integrally formed with the elongated neck 14 and extending downward therefrom is the shoulder region 16. The shoulder region 16 merges into and provides a transition between the elongated neck 14 and the body portion 18. The body portion 18 extends downward from the shoulder region 16 to the base 20 and includes sidewalls 30. The specific construction of the base 20 of the container 10 allows the sidewalls 30 for the heat-set container 10 to not necessarily require additional vacuum panels or pinch grips and therefore, can be generally smooth and glass-like. However, a significantly lightweight container will likely include sidewalls having vacuum panels, ribbing, and/or pinch grips along with the base 20.

The base 20 of the plastic container 10, which extends inward from the body portion 18, can comprise a chime 32, a contact ring 34 and a central portion 36. In some embodiments, the contact ring 34 is itself that portion of the base 20 that contacts a support surface 38 that in turn supports the container 10. As such, the contact ring 34 may be a flat surface or a line of contact generally circumscribing, continuously or intermittently, the base 20. The base 20 functions to close off the bottom portion of the plastic container 10 and, together with the elongated neck 14, the shoulder region 16, and the body portion 18, to retain the commodity.

In some embodiments, the plastic container 10 is preferably heat-set according to the above-mentioned process or other conventional heat-set processes. In some embodiments, o accommodate vacuum forces while allowing for the omission of vacuum panels and pinch grips in the body portion 18 of the container 10, the base 20 of the present teaching adopts a novel and innovative construction. Generally, the central portion 36 of the base 20 can comprise a central pushup 40 and an inversion ring 42. The inversion ring 42 can include an upper portion 54 and a lower portion 58. Additionally, the base 20 can include an upstanding circumferential wall or edge 44 that forms a transition between the inversion ring 42 and the contact ring 34.

As shown in the figures, the central pushup 40, when viewed in cross section, is generally in the shape of a truncated cone having a top surface 46 that is generally parallel to the support surface 38. Side surfaces 48, which are generally planar in cross section, slope upward toward the central longitudinal axis 50 of the container 10. The exact shape of the central pushup 40 can vary greatly depending on various design criteria. However, in general, the overall diameter of the central pushup 40 (that is, the truncated cone) is at most 30% of generally the overall diameter of the base 20. The central pushup 40 is generally where the preform gate is captured in the mold. Located within the top surface 46 is the sub-portion of the base 20 which includes polymer material that is not substantially molecularly oriented.

In some embodiments as shown in FIGS. 3, 5, 7, 10, 13 and 16, when initially formed, the inversion ring 42, having a gradual radius, completely surrounds and circumscribes the central pushup 40. As formed, the inversion ring 42 can protrude outwardly, below a plane where the base 20 would lie if it was flat. The transition between the central pushup 40 and the adjacent inversion ring 42 can be rapid in order to promote as much orientation as near the central pushup 40 as possible. This serves primarily to ensure a minimal wall thickness 66 for the inversion ring 42, in particular at the lower portion 58 of the base 20. In some embodiments, the wall thickness 66 of the lower portion 58 of the inversion ring 42 is between approximately 0.008 inch (0.20 mm) to approximately 0.025 inch (0.64 mm), and preferably between approximately 0.010 inch to approximately 0.014 inch (0.25 mm to 0.36 mm) for a container having, for example, an approximately 2.64-inch (67.06 mm) diameter base. Wall thickness 70 of top surface 46, depending on precisely where one takes a measurement, can be 0.060 inch (1.52 mm) or more; however, wall thickness 70 of the top surface 46 quickly transitions to wall thickness 66 of the lower portion 58 of the inversion ring 42. The wall thickness 66 of the inversion ring 42 must be relatively consistent and thin enough to allow the inversion ring 42 to be flexible and function properly. At a point along its circumventional shape, the inversion ring 42 may alternatively feature a small indentation, not illustrated but well known in the art, suitable for receiving a pawl that facilitates container rotation about the central longitudinal axis 50 during a labeling operation.

The circumferential wall or edge 44, defining the transition between the contact ring 34 and the inversion ring 42 can be, in cross section, an upstanding substantially straight wall approximately 0.030 inch (0.76 mm) to approximately 0.325 inch (8.26 mm) in length. Preferably, for a 2.64-inch (67.06 mm) diameter base container, the circumferential wall 44 can measure between approximately 0.140 inch to approximately 0.145 inch (3.56 mm to 3.68 mm) in length. For a 5-inch (127 mm) diameter base container, the circumferential wall 44 could be as large as 0.325 inch (8.26 mm) in length. The circumferential wall or edge 44 can be generally at an angle 64 relative to the central longitudinal axis 50 of between approximately zero degree and approximately 20 degrees, and preferably approximately 15 degrees. Accordingly, the circumferential wall or edge 44 need not be exactly parallel to the central longitudinal axis 50. The circumferential wall or edge 44 is a distinctly identifiable structure between the contact ring 34 and the inversion ring 42. The circumferential wall or edge 44 provides strength to the transition between the contact ring 34 and the inversion ring 42. In some embodiments, this transition must be abrupt in order to maximize the local strength as well as to form a geometrically rigid structure. The resulting localized strength increases the resistance to creasing in the base 20. The contact ring 34, for a 2.64-inch (67.06 mm) diameter base container, can have a wall thickness 68 of approximately 0.010 inch to approximately 0.016 inch (0.25 mm to 0.41 mm). In some embodiments, the wall thickness 68 is at least equal to, and more preferably is approximately ten percent, or more, than that of the wall thickness 66 of the lower portion 58 of the inversion ring 42.

Figure 8:
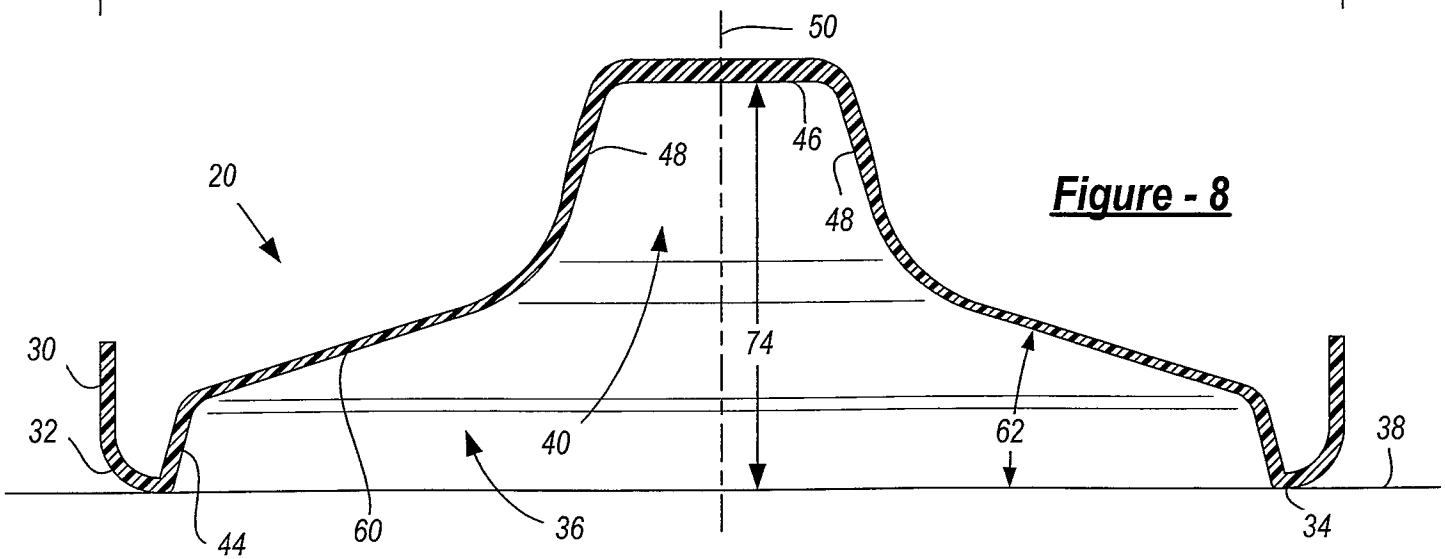
FIG. 8 is a cross-sectional view of the plastic container, similar to FIG. 6, according to some embodiments of the present teachings.
Figures 13, 14:
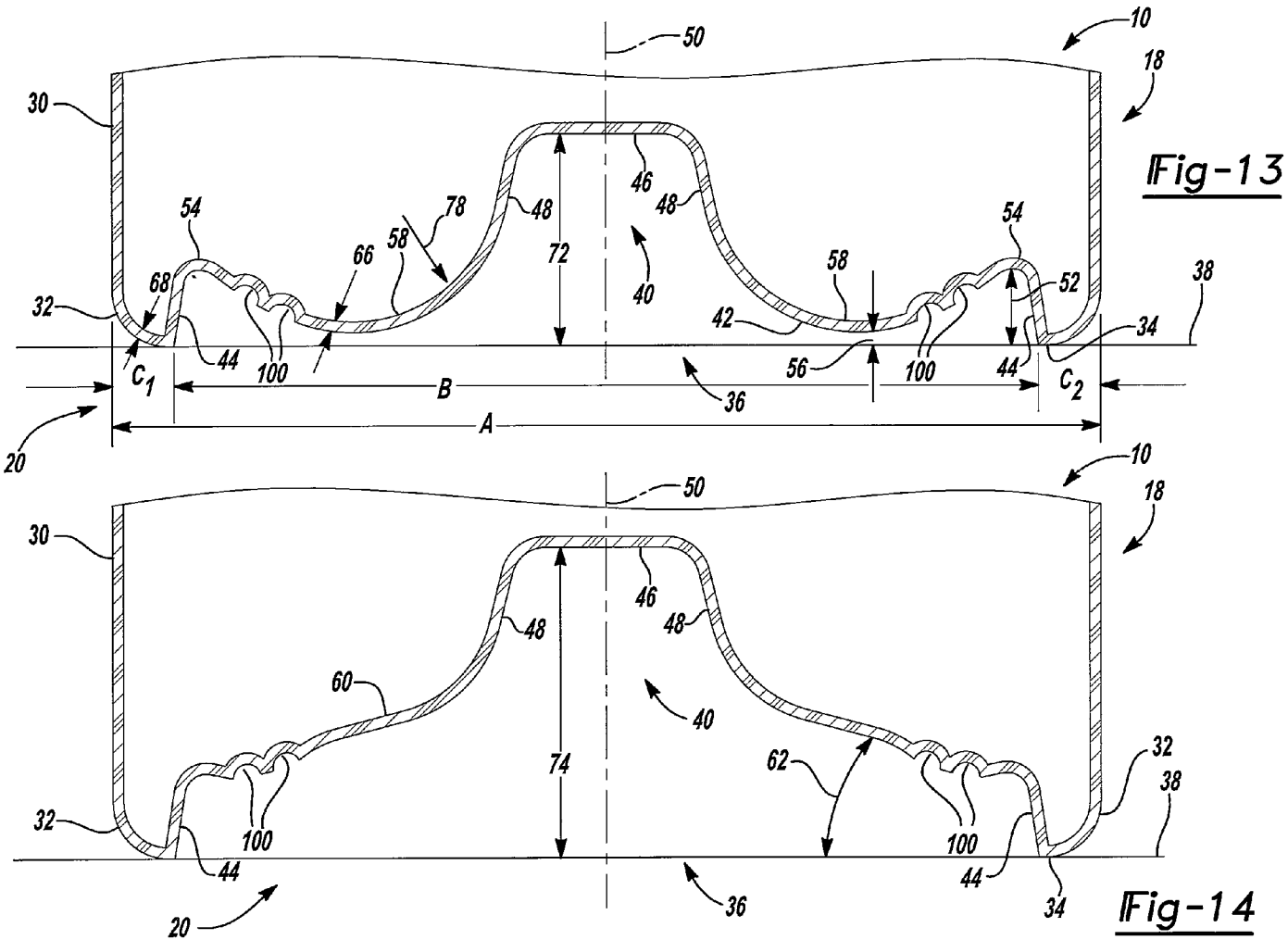
FIG. 13 is a cross-sectional view of the plastic container, similar to FIGS. 5 and 7, according to some embodiments of the present teachings.
FIG. 14 is a cross-sectional view of the plastic container, similar to FIGS. 6 and 8, according to some embodiments of the present teachings.
Figure 16:
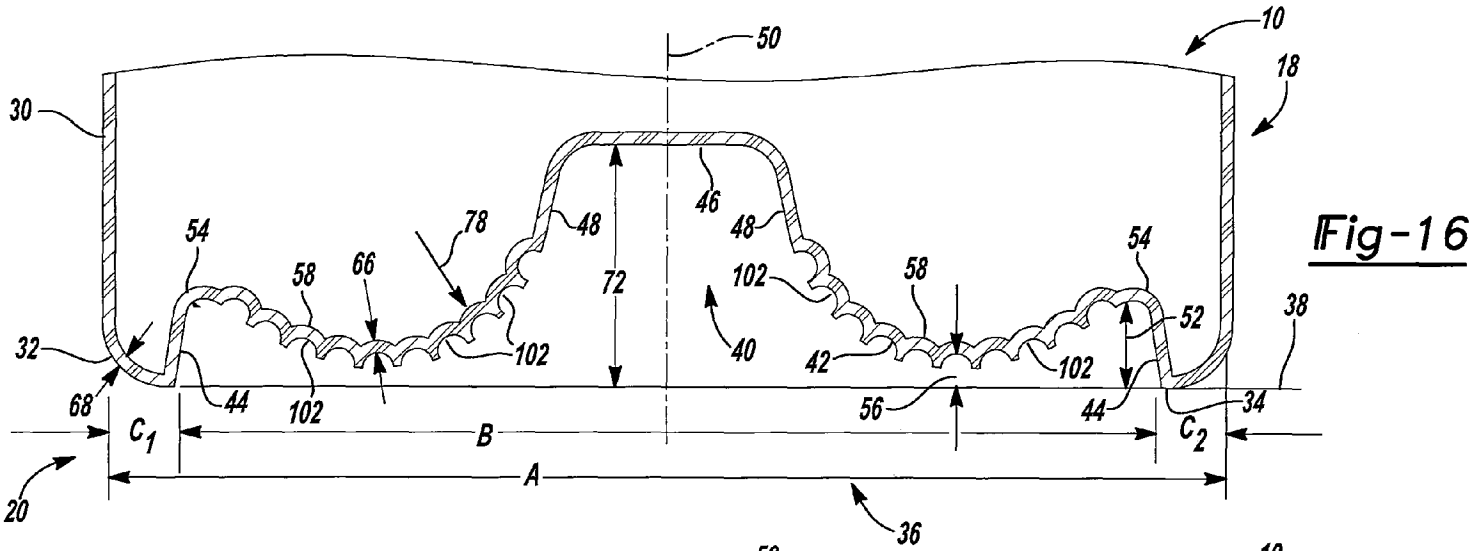
FIG. 16 is a cross-sectional view of the plastic container, similar to FIGS. 5 and 7, according to some embodiments of the present teachings.
Figure 17:
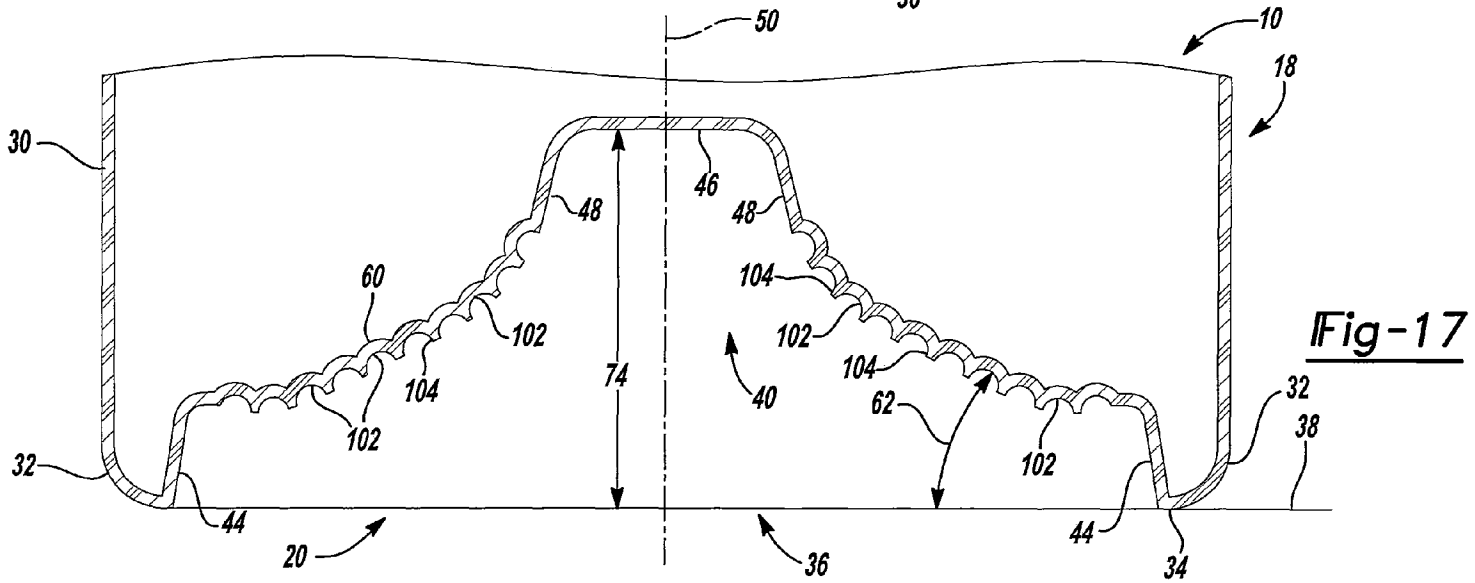
FIG. 17 is a cross-sectional view of the plastic container, similar to FIGS. 6 and 8, according to some embodiments of the present teachings.
Figure 15:
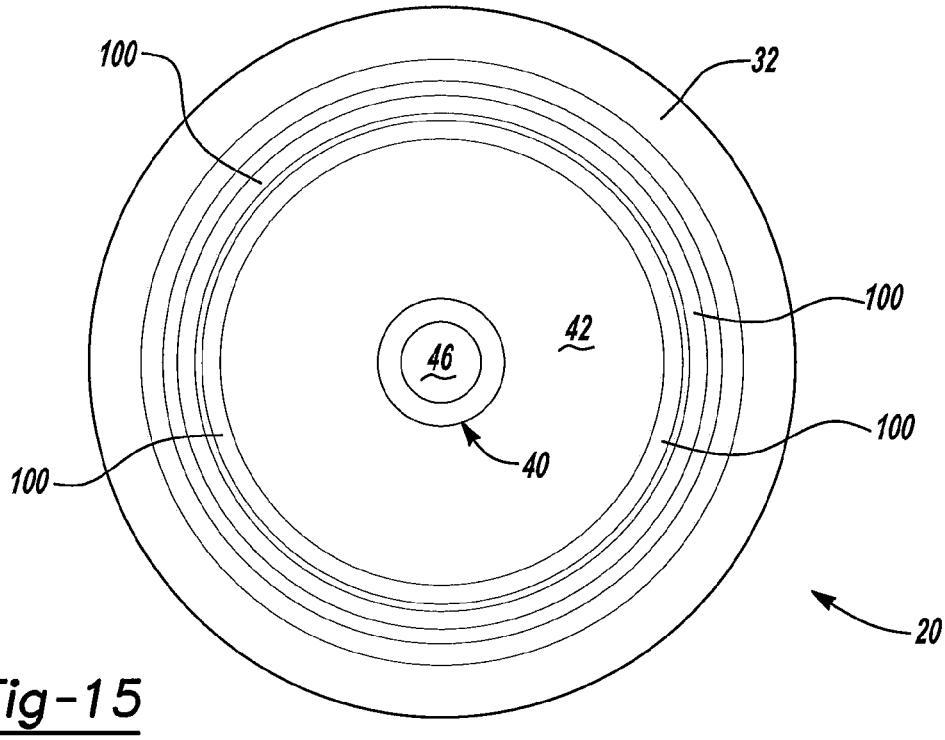
FIG. 15 is a bottom view of the plastic container according to some embodiments of the present teachings.
Figure 18:
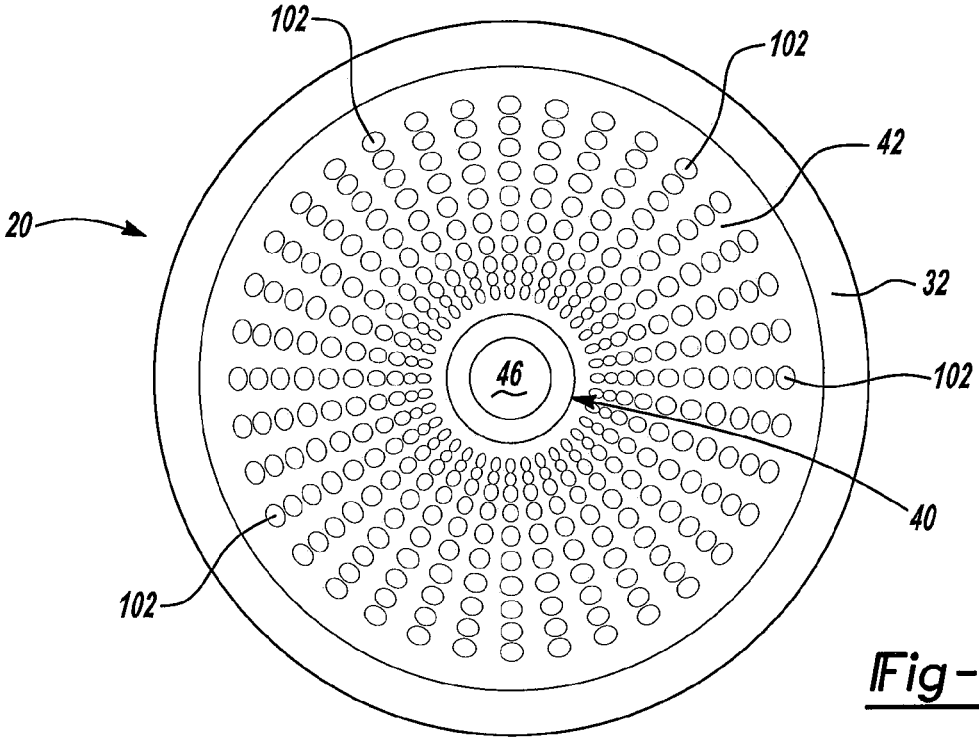
FIG. 18 is a bottom view of the plastic container according to some embodiments of the present teachings.

When initially formed, the central pushup 40 and the inversion ring 42 remain as described above and shown in FIGS. 1, 3, 5, 7, 10, 13 and 16. Accordingly, as molded, a dimension 52 measured between the upper portion 54 of the inversion ring 42 and the support surface 38 is greater than or equal to a dimension 56 measured between the lower portion 58 of the inversion ring 42 and the support surface 38. Upon filling, the central portion 36 of the base 20 and the inversion ring 42 will slightly sag or deflect downward toward the support surface 38 under the temperature and weight of the product. As a result, the dimension 56 becomes almost zero, that is, the lower portion 58 of the inversion ring 42 is practically in contact with the support surface 38. Upon filling, capping, sealing, and cooling of the container 10, as shown in FIGS. 2, 4, 6, 8, 12, 14 and 17, vacuum related forces cause the central pushup 40 and the inversion ring 42 to rise or push upward thereby displacing volume. In this position, the central pushup 40 generally retains its truncated cone shape in cross section with the top surface 46 of the central pushup 40 remaining substantially parallel to the support surface 38. The inversion ring 42 is incorporated into the central portion 36 of the base 20 and virtually disappears, becoming more conical in shape (see FIGS. 8, 14 and 17). Accordingly, upon capping, sealing, and cooling of the container 10, the central portion 36 of the base 20 exhibits a substantially conical shape having surfaces 60 in cross section that are generally planar and slope upward toward the central longitudinal axis 50 of the container 10, as shown in FIGS. 6, 8, 14 and 17. This conical shape and the generally planar surfaces 60 are defined in part by an angle 62 of approximately 7° to approximately 23°, and more typically between approximately 10° and approximately 17°, relative to a horizontal plane or the support surface 38. As the value of dimension 52 increases and the value of dimension 56 decreases, the potential displacement of volume within container 10 increases. Moreover, while planar surfaces 60 are substantially straight (particularly as illustrated in FIGS. 8 and 14), those skilled in the art will realize that planar surfaces 60 will often have a somewhat rippled appearance. A typical 2.64-inch (67.06 mm) diameter base container, container 10 with base 20, has an as molded base clearance dimension 72, measured from the top surface 46 to the support surface 38, with a value of approximately 0.500 inch (12.70 mm) to approximately 0.600 inch (15.24 mm) (see FIGS. 7, 13 and 16). When responding to vacuum related forces, base 20 has an as filled base clearance dimension 74, measured from the top surface 46 to the support surface 38, with a value of approximately 0.650 inch (16.51 mm) to approximately 0.900 inch (22.86 mm) (see FIGS. 8, 14 and 17). For smaller or larger containers, the value of the as molded base clearance dimension 72 and the value of the as filled base clearance dimension 74 may be proportionally different.

As set forth above, the difference in wall thickness between the base 20 and the body portion 18 of the container 10 is also of importance. The wall thickness of the body portion 18 must be large enough to allow the inversion ring 42 to flex properly. Depending on the geometry of the base 20 and the amount of force required to allow the inversion ring 42 to flex properly, that is, the ease of movement, the wall thickness of the body portion 18 must be at least 15%, on average, greater than the wall thickness of the base 20. Preferably, the wall thickness of the body portion 18 is between two (2) to three (3) times greater than the wall thickness 66 of the lower portion 58 of inversion ring 42. A greater difference is required if the container must withstand higher forces either from the force required to initially cause the inversion ring 42 to flex or to accommodate additional applied forces once the base 20 movement has been completed.

Figure 28:
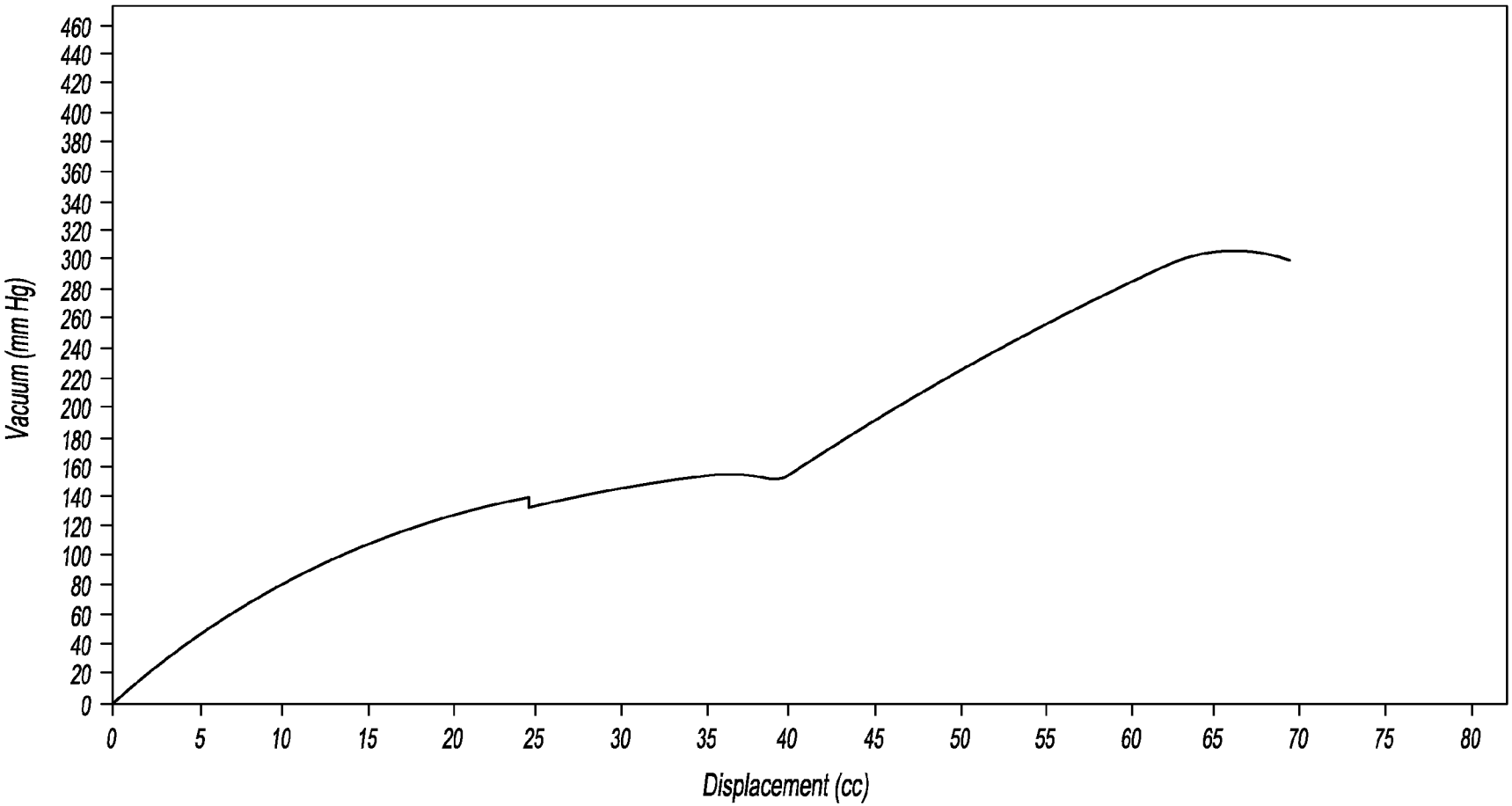
FIG. 28 is a graph illustrating the vacuum response versus displacement for the plastic container of FIG. 19.
Figure 29:
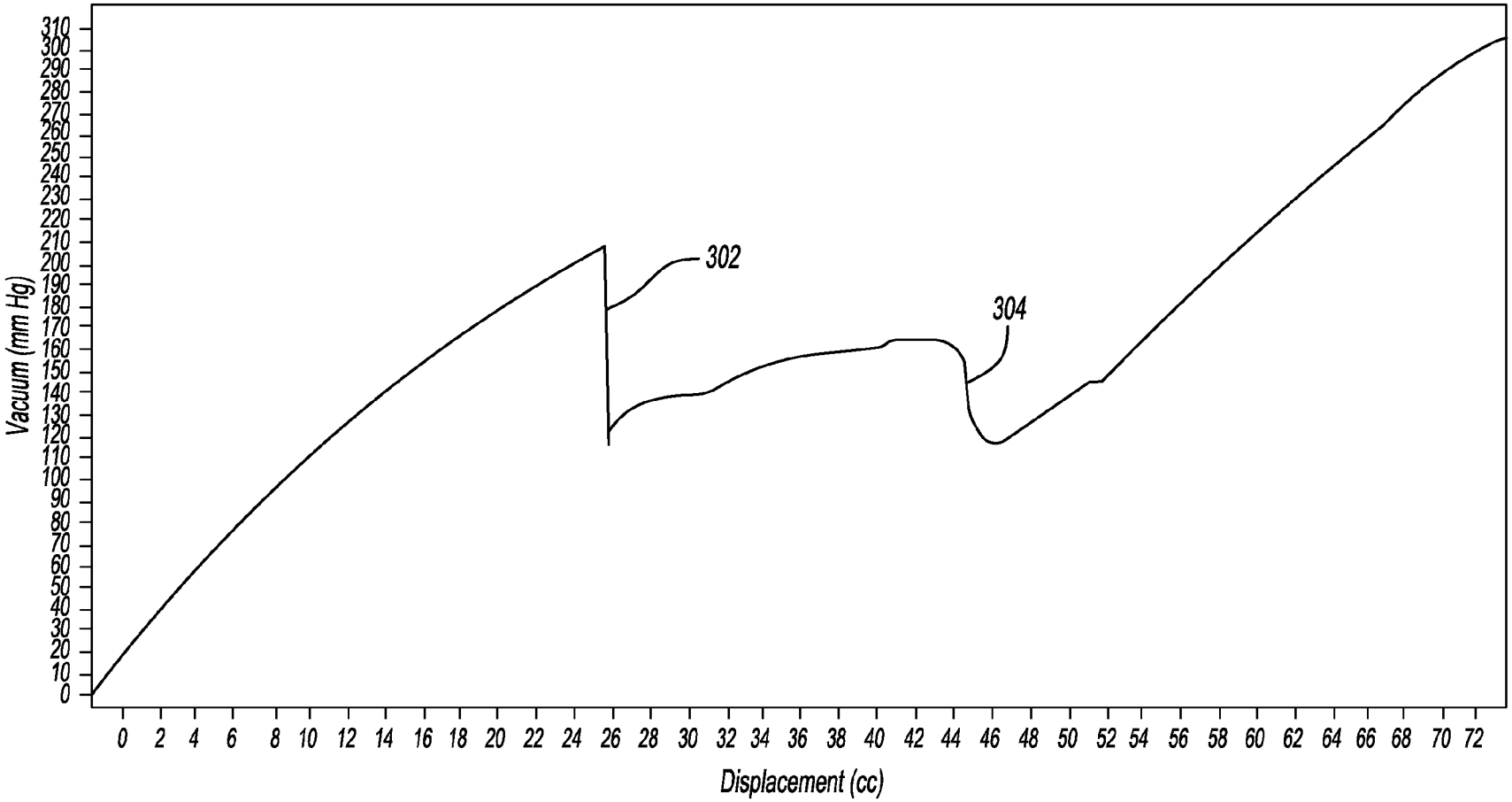
FIG. 29 is a graph illustrating the vacuum response versus displacement for the plastic container of FIG. 1.
Figure 30:
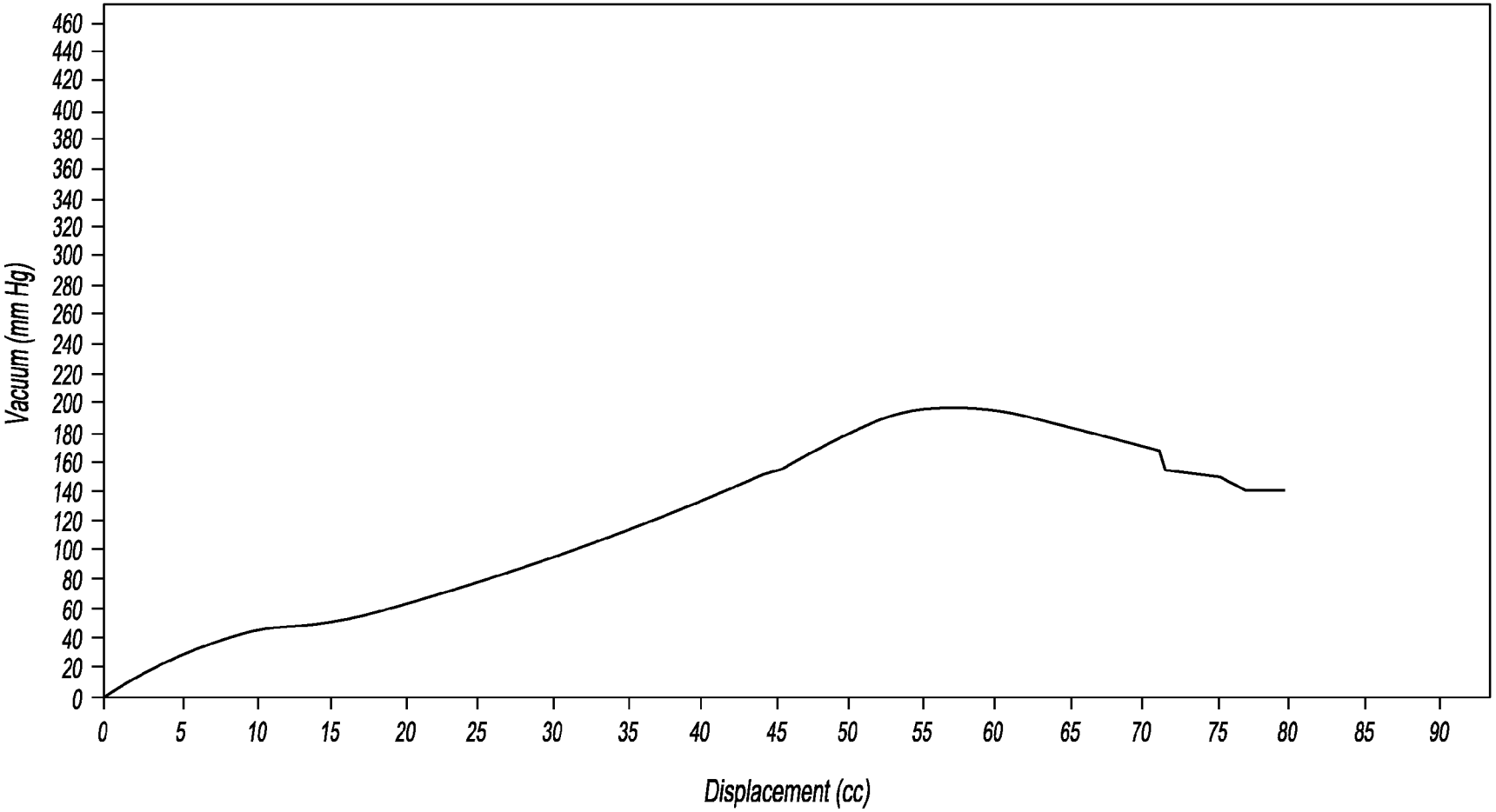
FIG. 30 is a graph illustrating the vacuum response versus displacement for the plastic container of FIG. 8.

In some embodiments, the above-described alternative hinges or hinge points may take the form of a series of indents, dimples, or other features that are operable to improve the response profile of the base 20 of the container 10. Specifically, as illustrated in FIGS. 28-30, in some embodiments the vacuum response profile of base 20 may define abrupt flexural responses that produce a segmented, non-continuous vacuum curve (see FIG. 29) defining a pair of vertical sections 302, 304, indicative of abruptly reduced internal vacuum pressure. Although this response may be suitable for some embodiments, in other embodiments a more gradual and smooth vacuum curve may be desired (see FIGS. 28 and 30 which will be discussed herein). In this way, a gradual and smooth vacuum curve profile may provide opportunity to redesign the sidewall profile and/or vacuum panels to reduces the need for vacuum panels and/or reduce material wall thickness along the sidewall. Such arrangement can provide reduced container weight and improved design possibilities.

That is, as illustrated in FIGS. 16-27, the inversion ring 42 may include a series of indents, dimples, or other features 102 formed therein and throughout. As shown (see FIGS. 16-20), in some embodiments, the series of features 102 are generally circular in shape. However, it should be appreciated that features 102 can define any one of a number of shapes, configurations, arrangements, distributions, and profiles With particular reference to FIGS. 16-27, in some embodiments, the features 102 are generally spaced equidistantly apart from one another and arranged in a series of rows and columns that completely cover the inversion ring 42. Similarly, the series of features 102 can generally and completely surround and circumscribe the central pushup 40 (see FIG. 18). It is equally contemplated that the series of rows and columns of features 102 may be continuous or intermittent. The features 102, when viewed in cross section, can be in the shape of a truncated or rounded cone having a lower most surface or point and side surfaces 104. Side surfaces 104 are generally planar and slope inward toward the central longitudinal axis 50 of the container 10. The exact shape of the features 102 can vary greatly depending on various design criteria. While the above-described geometry of the features 102 is preferred, it will be readily understood by a person of ordinary skill in the art that other geometrical arrangements are similarly contemplated.

Figure 19:
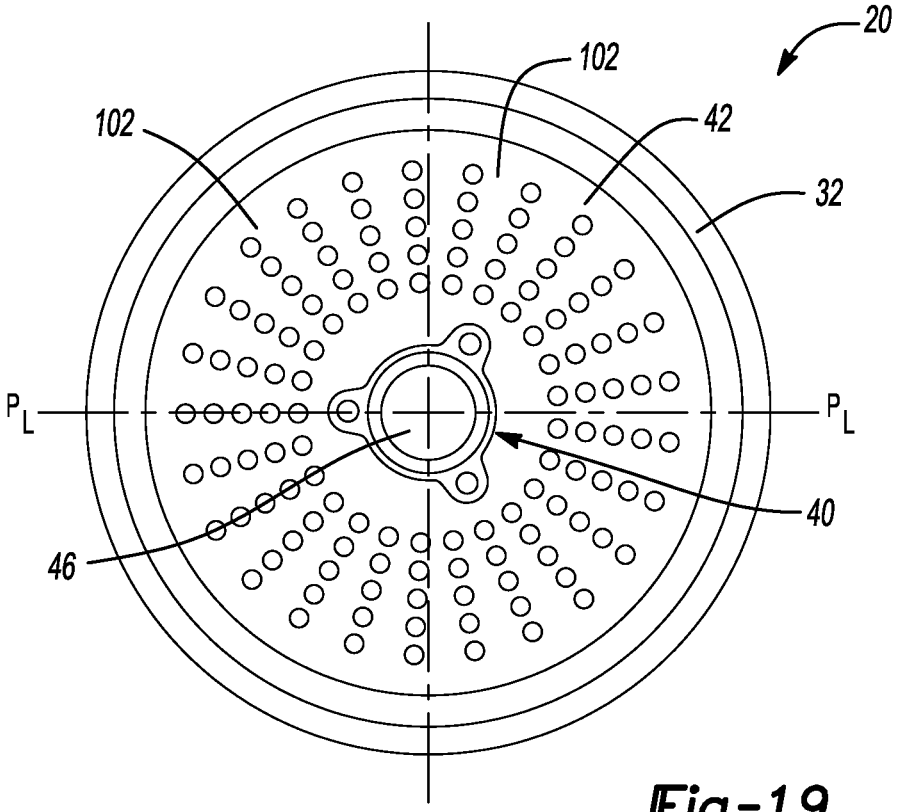
FIG. 19 is a bottom view of the plastic container according to some embodiments of the present teachings.
Figure 20:
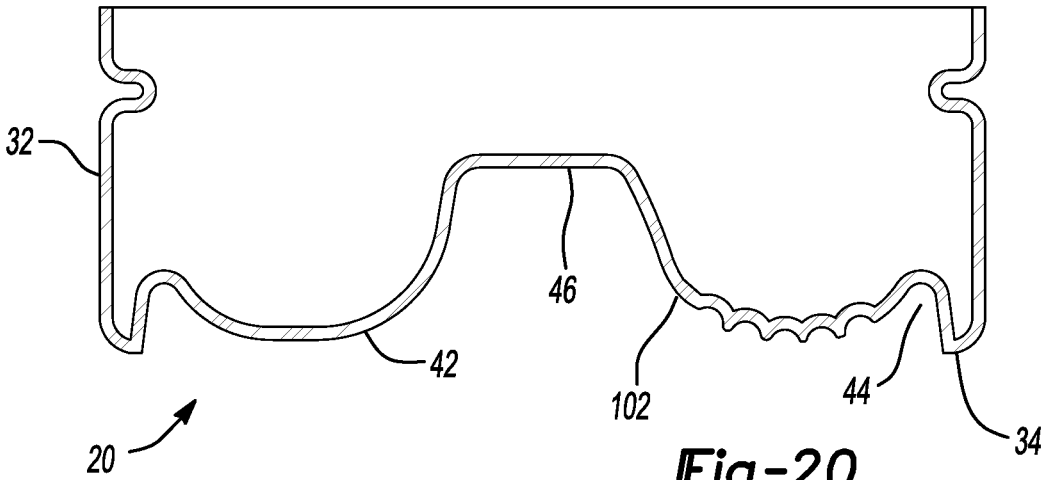
FIG. 20 is a cross-sectional view of the plastic container of FIG. 19.

With particular reference to FIGS. 19 and 20, the features 102 are illustrated as a similarly shaped series of dimples spaced equidistantly apart from one another as a plurality of radial row or columns extending from the central pushup 40 on inversion ring 42. Although illustrated as being inwardly directed within container 10, it should be appreciated that features 102 can be outwardly directed in some embodiments. It should also be understood that the particular size, shape, and distribution of dimples can vary depending upon the vacuum curve performance desired and provides control over base flexibility and movement under vacuum providing smooth actuation. As particularly illustrated in FIG. 28, it can be seen that under vacuum pressure load, base 20 and container 10, employing the base of FIGS. 19 and 20, produce a generally smooth and consistent vacuum curve defining a generally constant slope.

Figure 21:
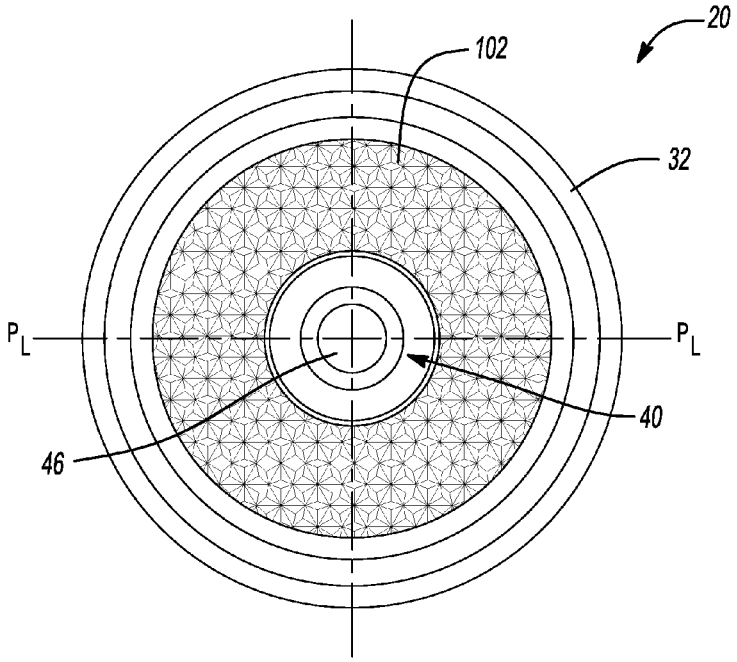
FIG. 21 is a bottom view of the plastic container according to some embodiments of the present teachings.
Figure 22:
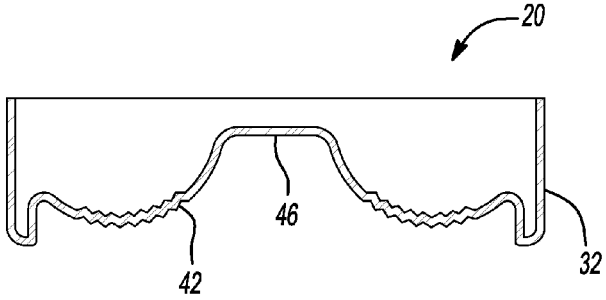
FIG. 22 is a cross-sectional view of the plastic container of FIG. 21.
Figure 23:
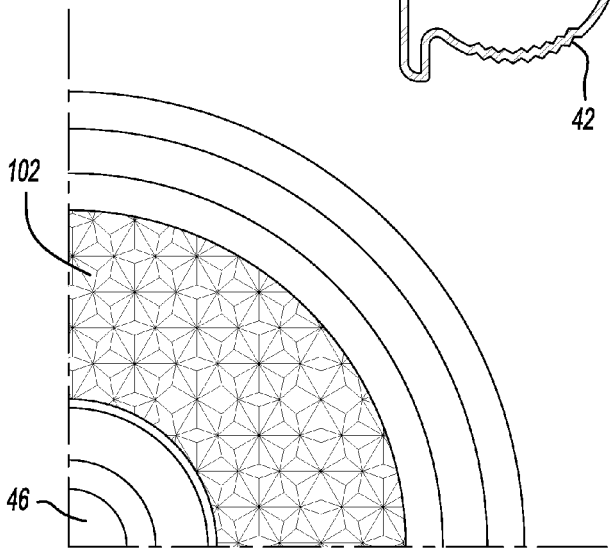
FIG. 23 is an enlarged bottom view of the plastic container of FIG. 21.

With particular reference to FIGS. 21-23, the features 102 are illustrated as a similarly shaped series of triangularly intersecting dimples spaced equidistantly apart from one another as a plurality of row or columns extending from the central pushup 40 on ring 42. Features 102 of the present embodiment are inwardly directed and define common boundaries with adjacent features 102 along edges of the inverted triangle. It should also be understood that the particular size, shape, and distribution of dimples can vary depending upon the vacuum curve performance desired and provides control over base flexibility and movement under vacuum providing smooth actuation.

Figure 24:
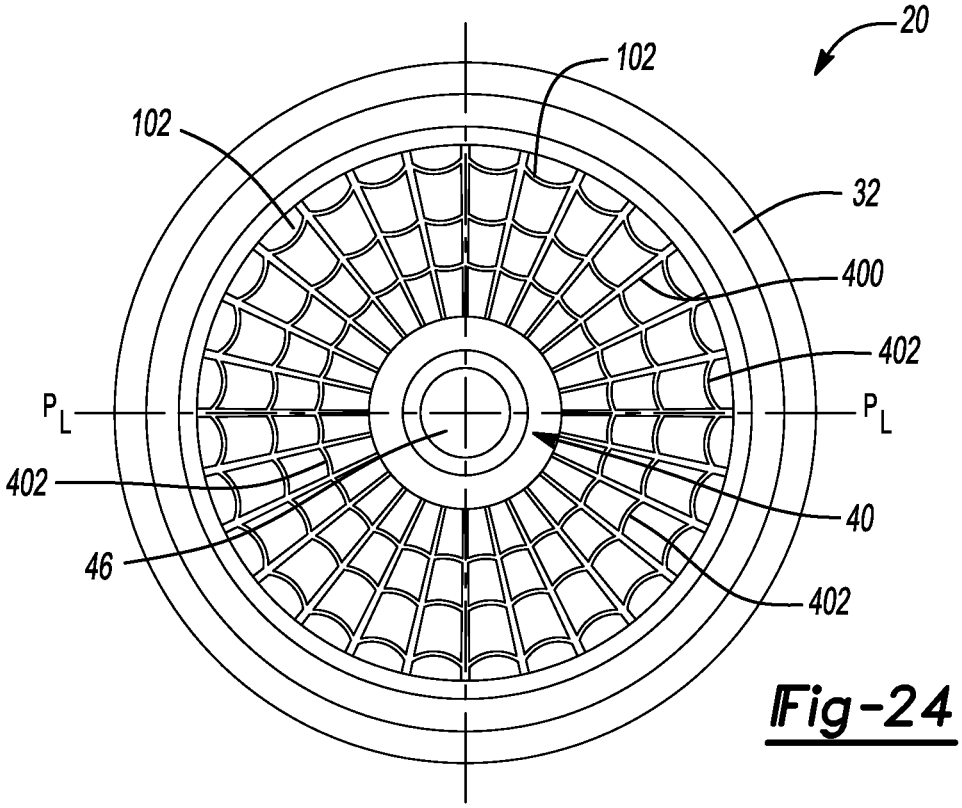
FIG. 24 is a bottom view of the plastic container according to some embodiments of the present teachings.
Figure 25:
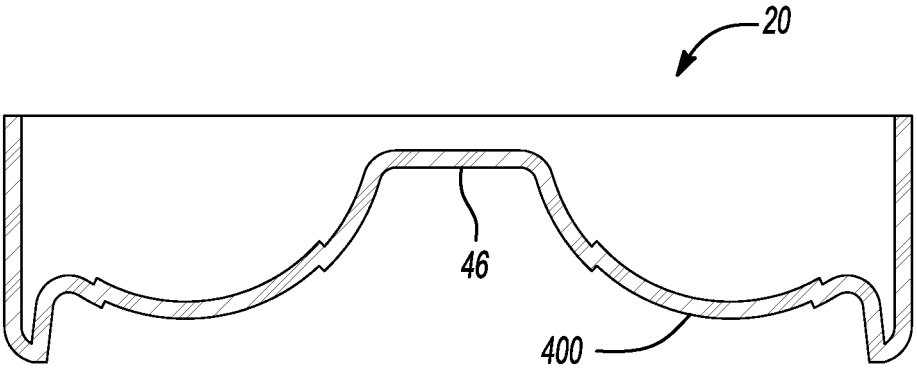
FIG. 25 is a cross-sectional view of the plastic container of FIG. 24.

With particular reference to FIGS. 24 and 25, the features 102 are illustrated as a spider web of radially extending creases 400 spaced equidistantly apart from one another extending from the central pushup 40 on ring 42. Creases 400 can be joined by a series of interconnecting creases 402, such as arcuate creases, extending between adjacent creases 400 forming a series of concentrically spaced circumferential rings extending about pushup 40. It should also be understood that the particular size, shape, and distribution of creases 400 and interconnecting creases 402 can vary depending upon the vacuum curve performance desired and provides control over base flexibility and movement under vacuum providing smooth actuation.

Figure 26:
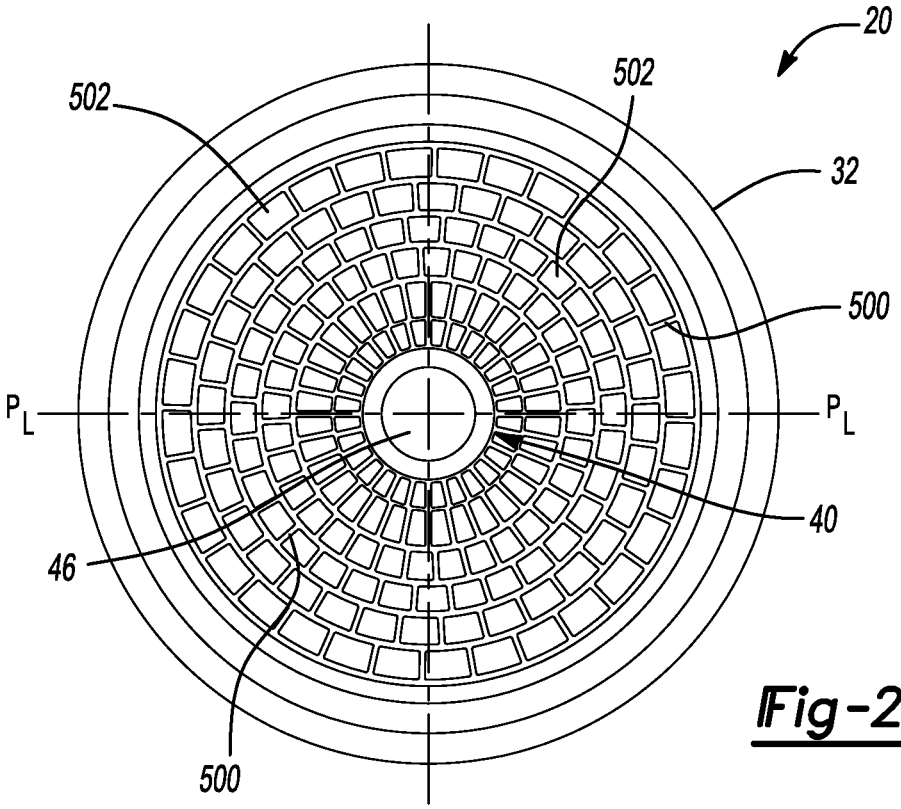
FIG. 26 is a bottom view of the plastic container according to some embodiments of the present teachings.
Figure 27:
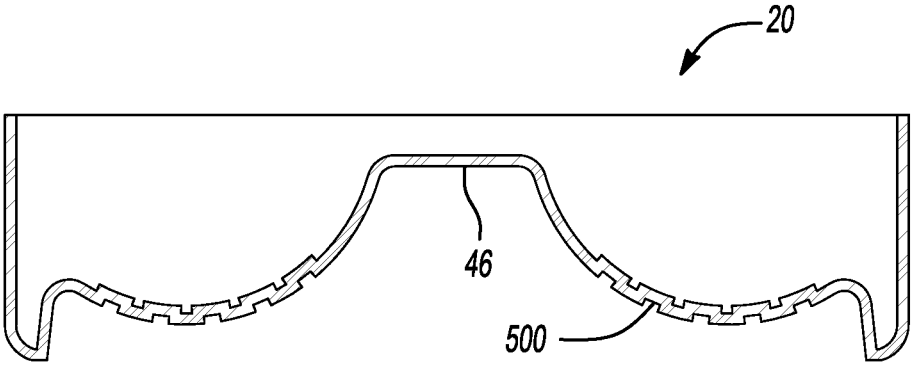
FIG. 27 is a cross-sectional view of the plastic container of FIG. 26.

With particular reference to FIGS. 26 and 27, the features 102 are illustrated as a similarly shaped series of circumferentially-extending creases 500 being spaced equidistantly apart from one another extending from the central pushup 40 on inversion ring 42. Circumferential creases 500 can be joined by a series of radially-extending, interconnecting creases 502 extending between adjacent circumferential creases 500. Circumferential creases 500 and radially-extending, interconnecting creases 502 together form a rotated brick design. It should be noted that radially-extending, interconnecting creases 502 can extending continuously from pushup 40 each as a single continuous crease or can be staggered to form the brick design. It should also be understood that the particular size, shape, and distribution of creases 500 and 502 can vary depending upon the vacuum curve performance desired and provides control over base flexibility and movement under vacuum providing smooth actuation.

As such, the above-described base designs cause initiation of movement and activation of the inversion ring 42 more easily by at least increasing the surface area of the base 20 and, in some embodiments, decreasing the material thickness in these areas. Additionally, the alternative hinges or hinge points also cause the inversion ring 42 to rise or push upward more easily, thereby displacing more volume. Accordingly, the alternative hinges or hinge points retain and improve the initiation and degree of response ease of the inversion ring 42 while optimizing the degree of volume displacement. The alternate hinges or hinge points provide for significant volume displacement while minimizing the amount of vacuum related forces necessary to cause movement of the inversion ring 42. Accordingly, when container 10 includes the above-described alternative hinges or hinge points, and is under vacuum related forces, the inversion ring 42 initiates movement more easily and planar surfaces 60 can often achieve a generally larger angle 62 than what otherwise is likely, thereby displacing a greater amount of volume.

Figure 9:
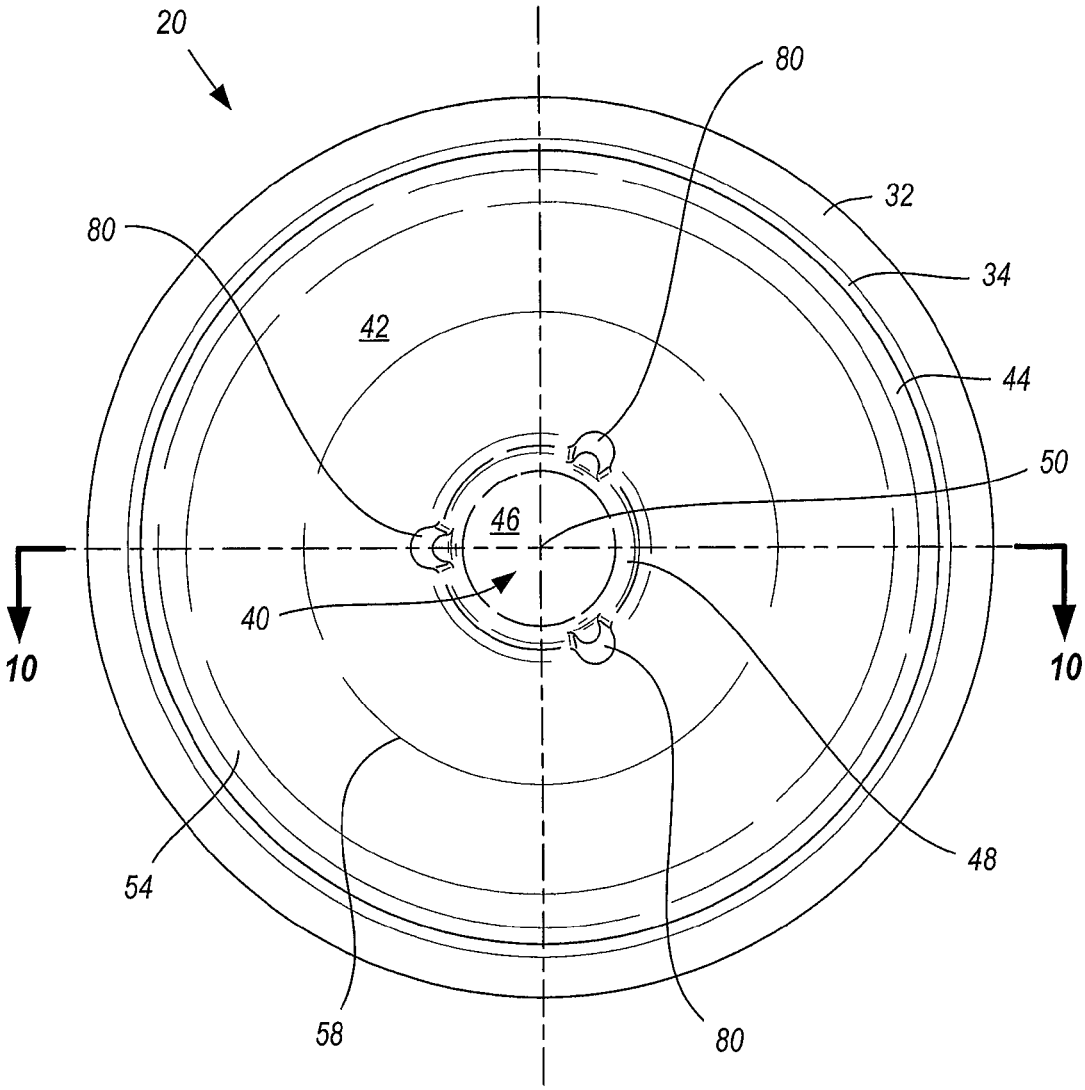
FIG. 9 is a bottom view of an additional embodiment of the plastic container, the container as molded and empty.
Figure 10:
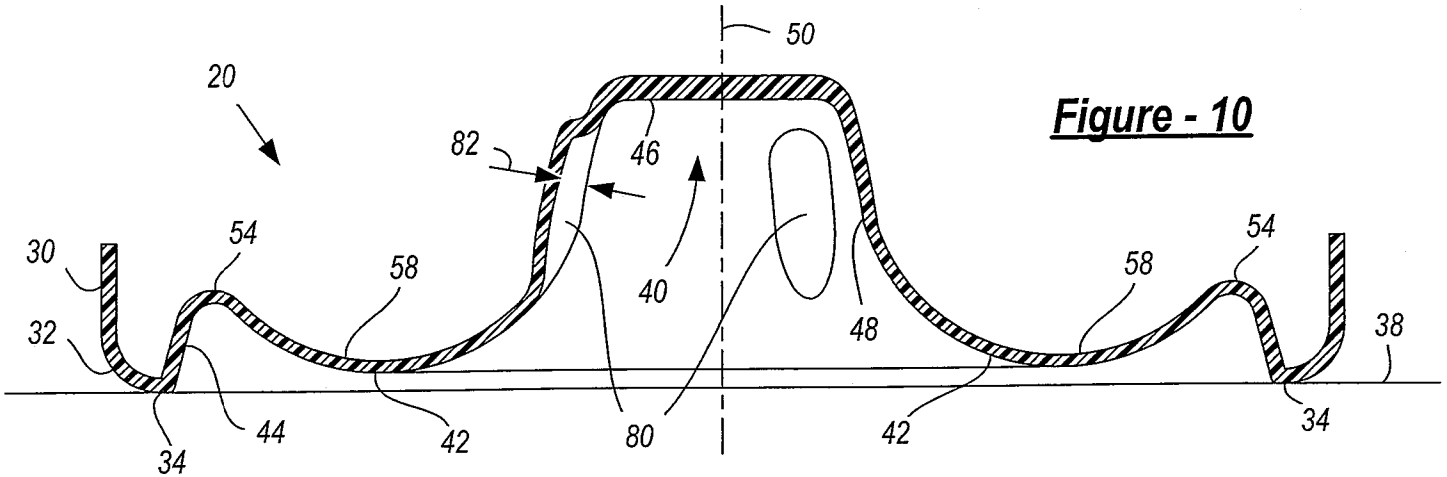
FIG. 10 is a cross-sectional view of the plastic container, taken generally along line 10-10 of FIG. 9.
Figure 12:
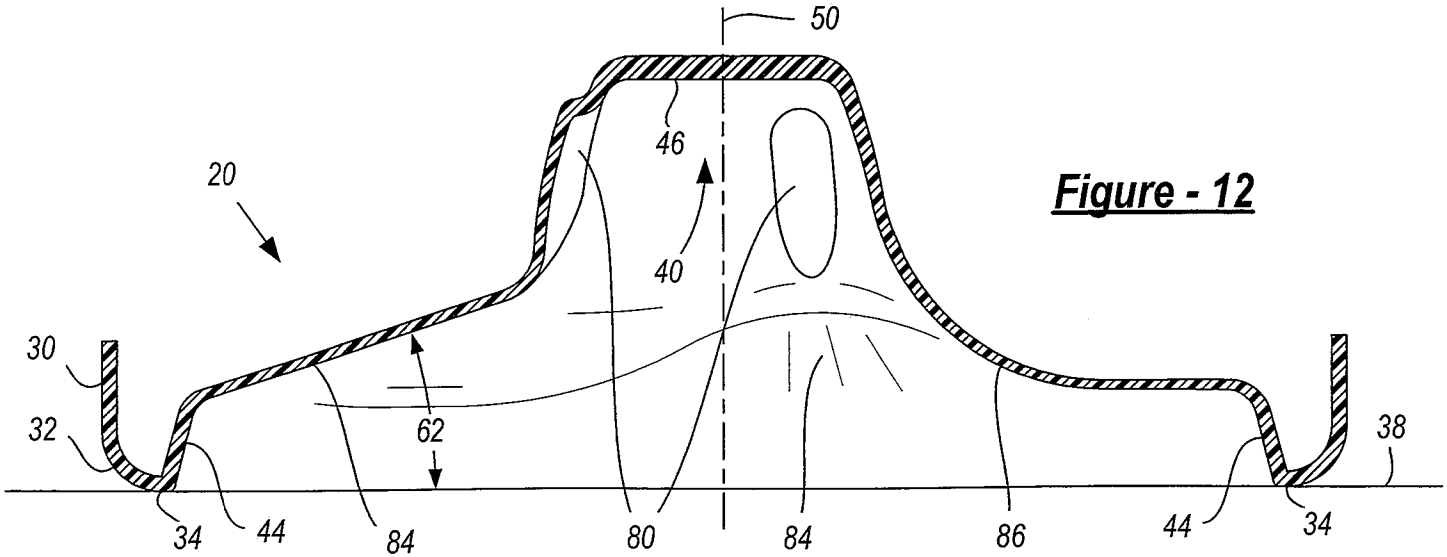
FIG. 12 is a cross-sectional view of the plastic container, taken generally along line 12-12 of FIG. 11.

While not always necessary, in some embodiments base 20 can comprise three grooves 80 substantially parallel to side surfaces 48. As illustrated in FIGS. 9 and 10, grooves 80 are equally spaced about central pushup 40. Grooves 80 have a substantially semicircular configuration, in cross section, with surfaces that smoothly blend with adjacent side surfaces 48. Generally, for container 10 having a 2.64-inch (67.06 mm) diameter base, grooves 80 have a depth 82, relative to side surfaces 48, of approximately 0.118 inch (3.00 mm), typical for containers having a nominal capacity between 16 fl. oz and 20 fl. oz. The inventors anticipate, as an alternative to more traditional approaches, that the central pushup 40 having grooves 80 may be suitable for engaging a retractable spindle (not illustrated) for rotating container 10 about central longitudinal axis 50 during a label attachment process. While three (3) grooves 80 are shown, and is the preferred configuration, those skilled in the art will know and understand that some other number of grooves 80, i.e., 2, 4, 5, or 6, may be appropriate for some container configurations.

Figure 11:
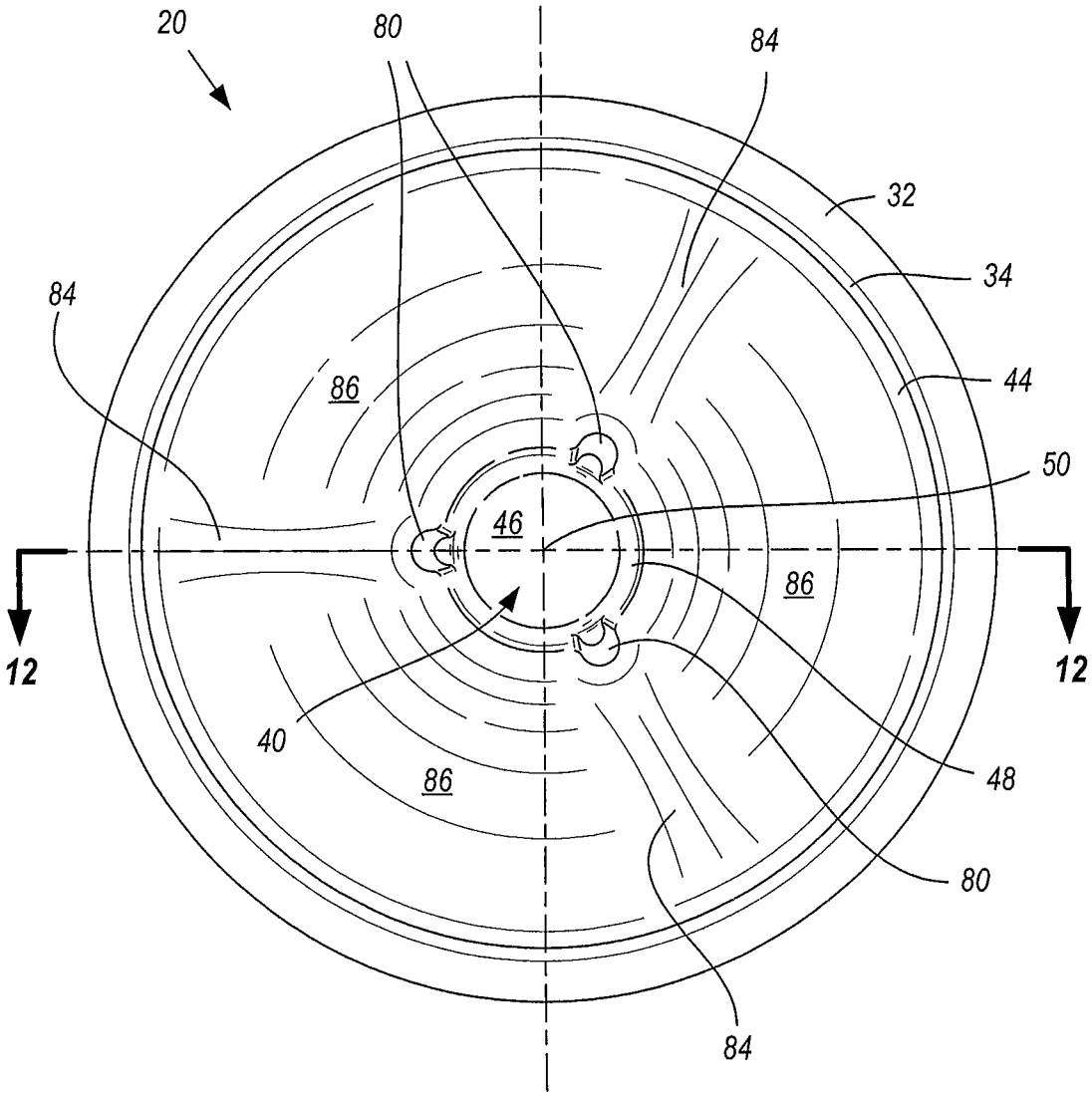
FIG. 11 is a bottom view of the embodiment of the plastic container shown in FIG. 9, the plastic container being filled and sealed.

As base 20, with a relative wall thickness relationship as described above, responds to vacuum related forces, grooves 80 may help facilitate a progressive and uniform movement of the inversion ring 42. Without grooves 80, particularly if the wall thickness 66 is not uniform or consistent about the central longitudinal axis 50, the inversion ring 42, responding to vacuum related forces, may not move uniformly or may move in an inconsistent, twisted, or lopsided manner. Accordingly, with grooves 80, radial portions 84 form (at least initially during movement) within the inversion ring 42 and extend generally adjacent to each groove 80 in a radial direction from the central longitudinal axis 50 (see FIG. 11) becoming, in cross section, a substantially straight surface having angle 62 (see FIG. 12). Said differently, when one views base 20 as illustrated in FIG. 11, the formation of radial portions 84 appear as valley-like indentations within the inversion ring 42. Consequently, a second portion 86 of the inversion ring 42 between any two adjacent radial portions 84 retains (at least initially during movement) a somewhat rounded partially inverted shape (see FIG. 12). In practice, the preferred embodiment illustrated in FIGS. 9 and 10 often assumes the shape configuration illustrated in FIGS. 11 and 12 as its final shape configuration. However, with additional vacuum related forces applied, the second portion 86 eventually straightens forming the generally conical shape having planar surfaces 60 sloping toward the central longitudinal axis 50 at angle 62 similar to that illustrated in FIG. 8. Again, those skilled in the art know and understand that the planar surfaces 60 will likely become somewhat rippled in appearance. The exact nature of the planar surfaces 60 will depend on a number of other variables, for example, specific wall thickness relationships within the base 20 and the sidewalls 30, specific container 10 proportions (i.e., diameter, height, capacity), specific hot-fill process conditions and others.

Figure 31:
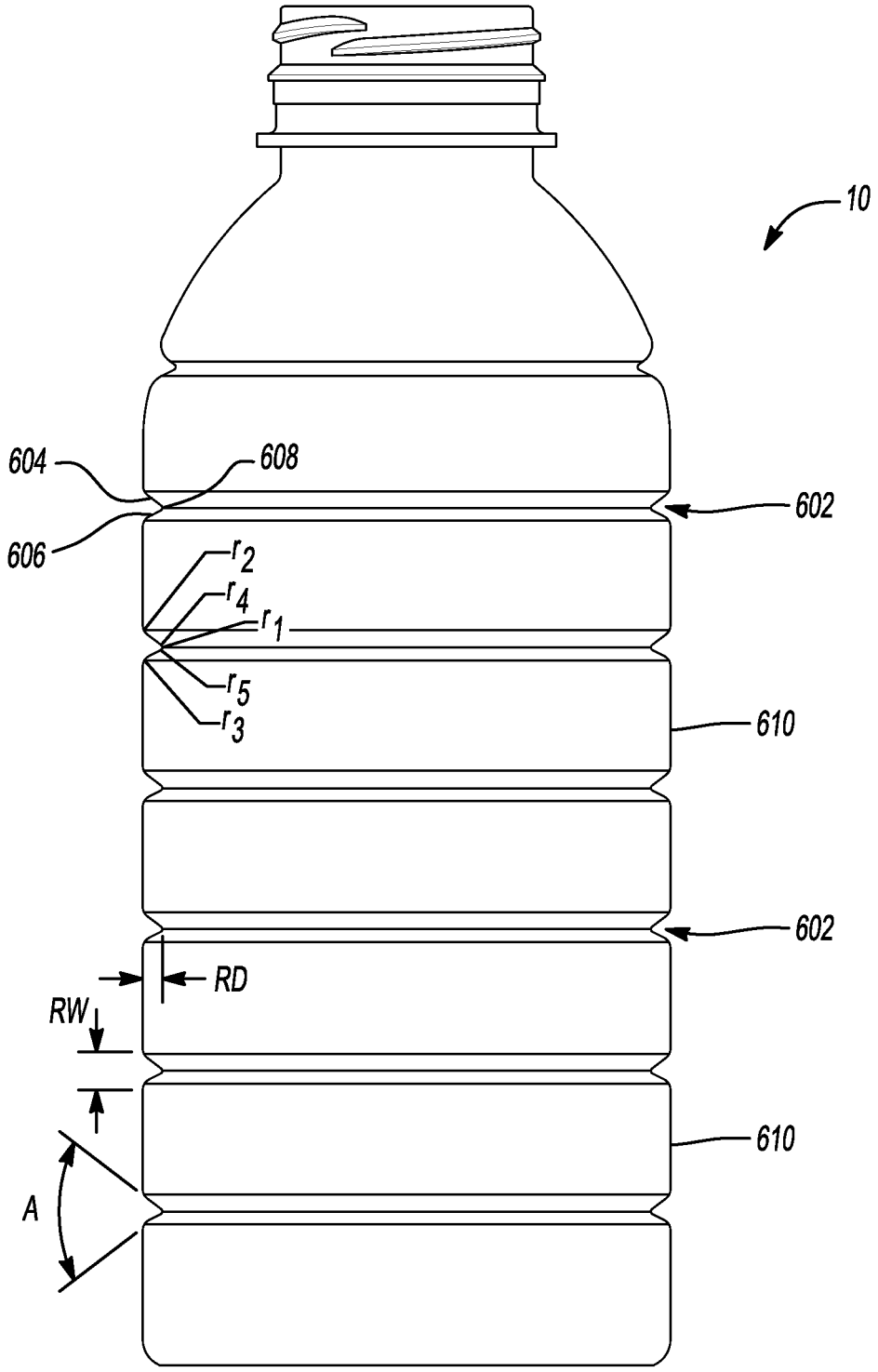
FIG. 31 is a cross-sectional view of a plastic container according to some embodiments of the present teachings.

The plastic container 10 may include one or more horizontal ribs 602. As shown in FIG. 31, horizontal ribs 602 further include an upper wall 604 and a lower wall 606 separated by an inner curved wall 608. Inner curved wall 608 is in part defined by a relatively sharp innermost radius $r_1$. In some embodiments, sharp innermost radius $r_1$ lies within the range of about 0.01 inches to about 0.03 inches. The relatively sharp innermost radius $r_1$ of inner curved wall 608 facilitates improved material flow during blow molding of the plastic container 10 thus enabling the formation of relatively deep horizontal ribs 602.

Horizontal ribs 602 each further include an upper outer radius $r_2$ and a lower outer radius $r_3$. Preferably both the upper outer radius $r_2$ and the lower outer radius r3 each lie within the range of about 0.07 inches to about 0.14 inches. The upper outer radius $r_2$ and the lower outer radius $r_3$ may be equal to each other or differ from one another. Preferably the sum of the upper outer radius $r_2$ and the lower outer radius $r_3$ will be equal to or greater than about 0.14 inches and less than about 0.28 inches.

As shown in FIG. 31, horizontal ribs 602 further include an upper inner radius $r_4$ and a lower inner radius $r_5$. The upper inner radius $r_4$ and the lower inner radius $r_5$ each lie within the range of about 0.08 inches to about 0.11 inches. The upper inner radius $r_4$ and the lower inner radius $r_5$ may be equal to each other or differ from one another. Preferably the sum of the upper inner radius $r_4$ and the lower inner radius $r_5$ will be equal to or greater than about 0.16 inches and less than about 0.22 inches.

Horizontal ribs 602 have a rib depth RD of about 0.12 inches and a rib width RW of about 0.22 inches as measured from the upper extent of the upper outer radius $r_2$ and the lower extent of the lower outer radius $r_3$. As such, horizontal ribs 602 each have a rib width RW to rib depth RD ratio. The rib width RW to rib depth RD ratio is, in some embodiments, in the range of about 1.6 to about 2.0.

Horizontal ribs 602 are designed to achieve optimal performance with regard to vacuum absorption, top load strength and dent resistance. Horizontal ribs 602 are designed to compress slightly in a vertical direction to accommodate for and absorb vacuum forces resulting from hot-filling, capping and cooling of the container contents. Horizontal ribs 602 are designed to compress further when the filled container is exposed to excessive top load forces.

As shown in FIG. 31, the above-described horizontal rib 602 radii, walls, depth and width in combination form a rib angle A. The rib angle A of an unfilled plastic container 10 may be about 58 degrees. After hot-filling, capping and cooling of the container contents, the resultant vacuum forces cause the rib angle A to reduce to about 55 degrees. This represents a reduction of the rib angle A of about 3 degrees as a result of vacuum forces present within the plastic container 10 representing a reduction in the rib angle A of about 5%. Preferably, the rib angle A will be reduced by at least about 3% and no more than about 8% as a result of vacuum forces.

After filling, it is common for the plastic container 10 to be bulk packed on pallets. Pallets are then stacked atop one another resulting in top load forces being applied to the plastic container 10 during storage and distribution. Thus, horizontal ribs 602 are designed so that the rib angle A may be further reduced to absorb top load forces. However, horizontal ribs 602 are designed so that the upper wall 604 and the lower wall 606 never come into contact with each other as a result of vacuum or top load forces. Instead horizontal ribs 602 are designed to allow the plastic container 10 to reach a state wherein the plastic container 10 is supported in part by the product inside when exposed to excessive top load forces thereby preventing permanent distortion of the plastic container 10. In addition, this enables horizontal ribs 602 to rebound and return substantially to the same shape as before the top load forces were applied, once such top load forces are removed.

Horizontal lands 610 are generally flat in vertical cross-section as molded. When the plastic container 10 is subjected to vacuum and/or top load forces, horizontal lands 610 are designed to bulge slightly outward in vertical cross-section to aid the plastic container 10 in absorbing these forces in a uniform way.

Figure 32:
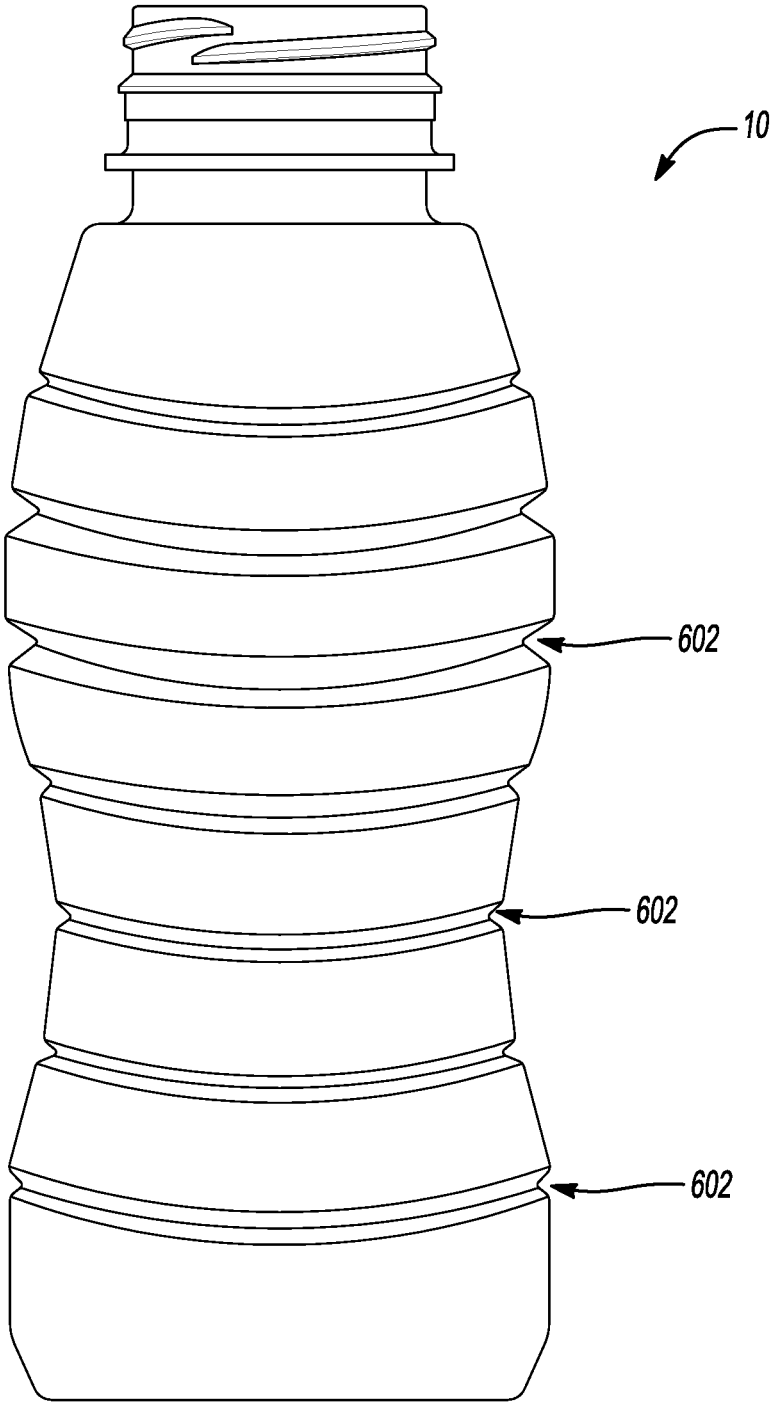
FIG. 32 is a cross-sectional view of a plastic container according to some embodiments of the present teachings.

It should be appreciated that ribs 602 may not be parallel to the base 20, as illustrated in FIG. 32. Stated differently, the ribs 602 may be arcuate in one or more directions about the periphery of the container 10 and the sidewall 30 of the container 10. More specifically, the ribs 602 may be arced such that a center of the ribs 602 is arced upward toward the neck 18. Such may be the case for all of the ribs 602 in the container 10 when viewed from the same side of the container 10. However, the ribs 602 may be arched in a different, opposite, downward direction, such as toward a bottom of the container 10. More specifically, a center of the ribs 602 may be closer to the base 20 than either of sides. In rotating the container 10 and following the ribs 602 for 360 degrees around the container 10, the ribs 602 may have two (2) equally high, highest points, and two (2) equally low, lowest points.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A plastic container comprising:

an upper portion having a mouth defining an opening into the container;

a base having a plurality of vacuum features formed along an underside thereof, said vacuum features of said base being movable to accommodate vacuum forces generated within the container thereby decreasing the volume of the container, said base being movable in response to a vacuum level less than 5% of said vacuum forces; and a substantially cylindrical portion extending between said upper portion and said base, said cylindrical portion having at least one horizontal circumferential rib, said at least one horizontal circumferential rib having a rib width to rib depth ratio of about 1.6 to about 2.0, and being movable to accommodate vacuum forces generated within the container thereby decreasing the volume of the container, said cylindrical portion being movable in response to a vacuum level less than 5% of said vacuum forces.

2. The plastic container according to claim 1 wherein said vacuum features are sufficient to create a vacuum force curve having a generally constant slope.

3. The plastic container according to claim 2 wherein said plurality of features are equidistantly disposed about said base.

4. The plastic container according to claim 2 wherein said plurality of features comprises a plurality of dimples disposed about said base for tailoring a vacuum response profile of said base.

5. The plastic container according to claim 4 wherein said plurality of dimples are disposed as radial rows extending from a central pushup.

6. The plastic container according to claim 1 wherein said base and said substantially cylindrical portion accommodate said vacuum forces simultaneously.

7. The plastic container according to claim 1 wherein said base and said substantially cylindrical portion accommodate said vacuum forces sequentially.

8. A plastic container comprising:

an upper portion having a mouth defining an opening into the container;

a base having a plurality of vacuum features formed along an underside thereof, said vacuum features of said base being movable to accommodate vacuum forces generated within the container thereby decreasing the volume of the container, said base accommodating between 10% and 90% of said vacuum forces; and a substantially cylindrical portion extending between said upper portion and said base, said cylindrical portion having at least one horizontal circumferential rib, said at least one horizontal circumferential rib having a rib width to rib depth ratio of about 1.6 to about 2.0, and being movable to accommodate vacuum forces generated within the container thereby decreasing the volume of the container, said cylindrical portion accommodating between 10% and 90% of said vacuum forces.

9. The plastic container according to claim 8 wherein said base and said substantially cylindrical portion accommodate said vacuum forces simultaneously.

10. The plastic container according to claim 8 wherein said base and said substantially cylindrical portion accommodate said vacuum forces sequentially.

* * * * *